United States Patent [19]

Imamura et al.

[11] 4,275,634

[45] Jun. 30, 1981

[54] ELECTRONIC MUSICAL INSTRUMENT WITH AUTOMATIC ARPEGGIO FACULTY

[75] Inventors: Akio Imamura; Eiichi Yamaga; Akira Nakada, all of Hamamatsu, Japan

[73] Assignee: Nippon Gakki Seizo Kabushiki Kaisha, Hamamatsu, Japan

[21] Appl. No.: 92,082

[22] Filed: Nov. 7, 1979

[30] Foreign Application Priority Data

Nov. 10, 1978 [JP] Japan ..... 53-138594

[51] Int. Cl.[3] ..... G10H 1/28; G10H 5/00

[52] U.S. Cl. ..... 84/1.03; 84/1.24; 84/DIG. 12; 84/DIG. 22

[58] Field of Search ..... 84/1.01, 1.03, 1.24, 84/DIG. 12, DIG. 22

[56] References Cited

U.S. PATENT DOCUMENTS

| | | | |
|---|---|---|---|
| 4,148,017 | 4/1979 | Tomisawa | 84/1.01 X |
| 4,154,131 | 5/1979 | Studer et al. | 84/1.03 |
| 4,156,379 | 5/1979 | Studer | 84/1.03 |
| 4,158,978 | 6/1979 | Hiyoshi et al. | 84/1.03 |
| 4,160,404 | 7/1979 | Yamada et al. | 84/1.03 X |
| 4,192,211 | 3/1980 | Yamaga et al. | 84/1.01 |
| 4,217,804 | 8/1980 | Yamaga et al. | 84/1.03 |

FOREIGN PATENT DOCUMENTS 54-39621 3/1979 Japan .

*Primary Examiner*—S. J. Witkowski

*Attorney, Agent, or Firm*—Spensley, Horn, Jubas & Lubitz

[57] ABSTRACT

An electronic musical instrument is of a channel assignment type and simultaneously produces a plurality of tones in automatic arpeggio performance. For that purpose, the instrument incorporates a plurality of automatic arpeggio performance channels. An automatic arpeggio performance is carried out in accordance with an arpeggio pattern. In order to simultaneously produce a plurality of automatic arpeggio tones, the instrument assigns respective arpeggio composing tones for the plural arpeggio performance channels by using an arpeggio pattern for one-tone production and a change pattern obtained by adding change information to the arpeggio pattern. Thus an automatic performance of polyphonic arpeggio is realized.

12 Claims, 9 Drawing Figures

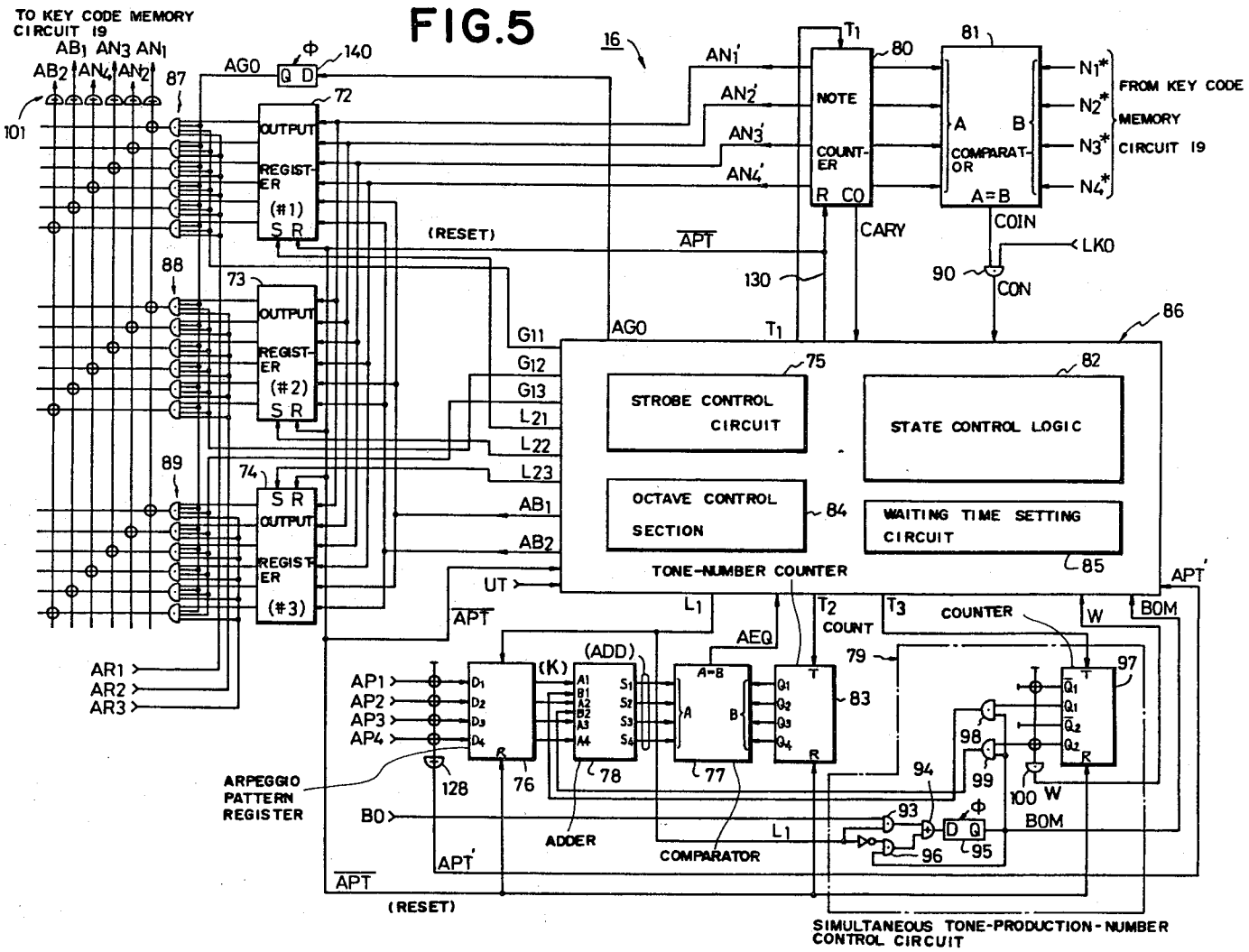
FIG.5
FROM KEY CODE MEMORY CIRCUIT 19
N1* N2* N3* N4*
81
COMPARATOR
A=B
COIN
LKO
CON
90
80
NOTE
COUNTER
CARY
T1
130
AN1' AN2' AN3' AN4'
APT
16
AG0
140
72
OUTPUT
REGISTER (#1)
REGISTER (#2)
REGISTER (#3)
73
74
87
88
89
101
TO KEY CODE MEMORY CIRCUIT 19
AB1 AN3 AN1
AB2 AN4 AN2
AR1 AR2 AR3
(RESET)
86
82
STATE CONTROL LOGIC
WAITING TIME SETTING CIRCUIT
85
75
STROBE CONTROL CIRCUIT
84
OCTAVE CONTROL SECTION
TONE-NUMBER COUNTER
G11 G12 G13 L21 L22 L23 AB1 AB2
UT
APT'
BOM
W
T3 COUNTER
T2 COUNT
AEQ
L1
79
83
77
COMPARATOR
(ADD)
78
ADDER
(K)
76
128
AP1 AP2 AP3 AP4
BO
ARPEGGIO PATTERN REGISTER
97
100 W BOM
98
99
95
94
93
96
SIMULTANEOUS TONE-PRODUCTION-NUMBER CONTROL CIRCUIT (B0='1')
(a) F1
(b) F2
(c)
(d) APT
(e) C18
(f) L1
(g) T1
(h) CON
(i) T2(L2)
(j) AEQ
(k) AGO
(l) AR1 (OR AR2.AR3)
(m) AN1~AB2
(n) T4
(o) ADD
(p) STROBE COUNTER 102
(q) T3
ST1 AND ST2 ARE REPEATED WHEN EXHIBITS NOT-COINCIDENT
ST0
ST1
ST2
ST3
18μs
1μs
(COUNTS UP AT EVERY 18μs)
(COUNTS UP AT EVERY 18μs)
(COUNTS UP BY NUMBER OF CON)
(L21)
(L22)
(L23)
NOT COINCIDENT
COINCIDENT
AR1
AR2
AR3
REGISTER 72
REGISTER 73
REGISTER 74
k
k+1
k+2
0
1
2
TIME

ELECTRONIC MUSICAL INSTRUMENT WITH AUTOMATIC ARPEGGIO FACULTY

BACKGROUND OF THE INVENTION

This invention relates to an electronic musical instrument of a channel assignment type and capable of carrying out an automatic arpeggio performance.

An electronic musical instrument of a channel assignment type is known in the art, in which a plurality (small particular number) of tone production channels are provided and the data of keys depressed from among a larger plurality of keys are assigned to some of the tone production channels, so that a plurality of tones are produced simultaneously through the tone production channels. Such an electronic musical instrument is so designed that the same single key is not assigned to a plurality of tone production channels. One example of the electronic musical instrument of this type is disclosed in the specification of U.S. Pat. No. 4,158,978 entitled "Electronic Musical Instrument". In the electronic musical instrument disclosed in the specification of said U.S. Patent, a chord pyramid performance which is a kind of or somewhat similar to an automatic arpeggio performance is carried out. More specifically, after the tone productions of one or plural keys depressed in the keyboard are assigned individually to one or plural tone production channels, the timings of musical tone productions in the tone production channels are controlled, so that the one or plural tones are sequentially produced one at a time at predetermined time intervals. Accordingly, in the tone production channels to which the keys depressed for the chord pyramid performance (automatic arpeggio performance) have been assigned, the tones are not always produced in response to the key depressions; that is, the tone production is effected only in the tone production channel which has been selected by the tone production timing control, and the tone production channel in which the tone production is actually effected in successively switched (selected). In this case, the number of tone production channels is limited (for instance, to twelve). Accordingly, as the number of keys depressed for the automatic performance is increased, the number of channels in which ordinary tone production is effected just following the key depression is reduced.

In order to eliminate the difficulty described above, Japanese Patent Application No. 1977-106417 entitled "Electronic Musical Instrument" (Open-Laying No. 1979-39621) has been proposed. More specifically, in an electronic musical instrument having a plurality of tone production channels, an exclusive channel is provided for an automatic arpeggio performance, so that automatic arpeggio tones are produced one after another in that exclusive channel. In this case, the tones of keys depressed in the keyboard are produced in the ordinary tone production channels in the usual manner according to the way of the key depressions and additionally are produced selectively in the automatic arpeggio exclusive channel.

However, it should be noted that in the above-described two prior arts and also in any automatic arpeggio performance arts provided before them it is impossible to simultaneously produce two tones or more in arpeggio pattern (i.e. polyphonic arpeggio); that is, the automatic arpeggio performance is so monotonous as only one tone is produced at a time.

SUMMARY OF THE INVENTION

In view of the foregoing, an object of this invention is to provide an electronic musical instrument in which a plurality of tones can be simultaneously produced in an automatic arpeggio performance.

In order to achieve this object, in an electronic musical instrument having a plurality of tone production channels, according to the invention, a plurality of automatic arpeggio performance exclusive channels are provided, so that a plurality of automatic arpeggio tones are simultaneously produced in the exclusive channels.

In this invention, similarly as in the prior invention U.S. Patent Application Ser. No. 952,098 now U.S. Pat. No. 4,217,804 assigned to the same assignee as this case, an automatic arpeggio performance is carried out in accordance with a predetermined pattern (arpeggio pattern). The arpeggio pattern specifies at which timing the arpeggio tones should be produced and which tone(s) should be produced from among the arpeggio compositing (constituent) tones at each designated timing. One arpeggio pattern consists of one set of data. The value of each data specifies the pitch location order of each arpeggio tone which should be produced, the order being counted from the lowest side or the highest side of the arpeggio composing forming tones. For instance, if the arpeggio pattern data at a tone production timing specifies a value one (1), the lowest one of the arpeggio composing tones is produced, and if it specifies a value two (2), then the second tone from the lowest tone is produced. In the case where the value specified by the arpeggio pattern is larger than the total number of arpeggio compositing tones, the arpeggio composing tones are repeatedly counted by returning back to the tone from which the counting is started until the count becomes said value, and the octave number is increased as much as the number of times of returning. For instance, in the case where the arpeggio pattern specifies four (4) when three keys are depressed (the number of arpeggio composing tones being three (3)), the lowest one of the arpeggio composing tones is produced at a tone pitch of one octave above. The octave may not be changed as described above, and instead it may be specified by utilizing octave data separately provided.

In the invention, a plurality of arpeggio tones can be simultaneously produced by adding change (modification) data to an arpeggio pattern data for one-tone-at-a-time production. The change data may be provided selectively by means of switching operation, or a change data generation pattern together with an arpeggio pattern may be stored in a read-only memory or the like in advance. When the change data is provided, one arpeggio composing tone having the order specified by the arpeggio pattern data is assigned to one automatic arpeggio exclusive channel, the value of the data is changed in one or plural ways, and the remaining arpeggio composing tones having the pitch location orders specified by the data thus changed are assigned to the remaining arpeggio exclusive channels. Thus, the arpeggio composing tones are assigned to the plural automatic arpeggio exclusive channels, respectively, and the plural arpeggio tones can be simultaneously produced.

BRIEF DESCRIPTION OF THE DRAWINGS

In the accompanying drawings:

FIG. 5 is a circuit diagram showing details of an automatic arpeggio circuit in FIG. 1;

DETAILED DESCRIPTION OF THE INVENTION

One preferred embodiment of this invention will be described with reference to the accompanying drawings.

Figure 1:
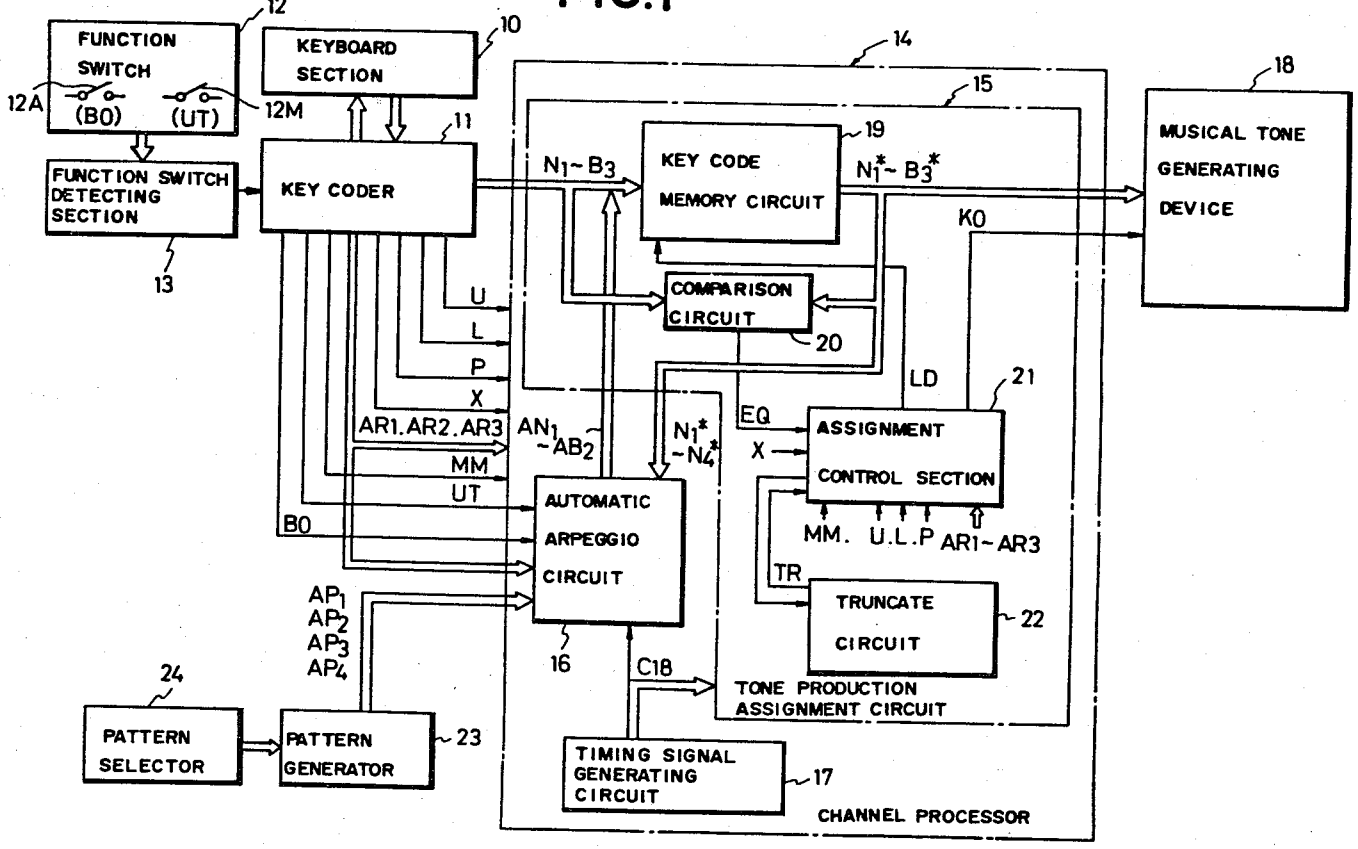
FIG. 1 is a block diagram showing the whole arrangement of one example of an electronic musical instrument according to this invention.

Referring to FIG. 1, a keyboard section 10 comprises an upper keyboard, a lower keyboard, and a pedal keyboard each including keys, and a key coder 11 operates to detect the on-off operation of each key in the keyboard section 10 to output data representative of the key depression, i.e. a key code of seven bits; $B_3$, $B_2$, $B_1$, $N_4$, $N_3$, $N_1$ and $N_1$. A function switch section 12 has a variety of switches. A function switch detecting section 13 detects the on-off operation of each switch in the function switch section 12. After being serialised, the detection results are applied to the key coder 11. In the key coder 11, the serial signals applied thereto from the function switch detection section 13 are subjected to parallel conversion, so that the detection outputs of the function switches are outputted in a parallel mode. The function switch section 12 includes a switch 12A for selecting the number of simultaneously produced arpeggio tones and an arpeggio mode change-over switch 12M. The switch 12A is to select the number of automatic arpeggio tones simultaneously produced. In response to the operation of the switch 12A, a simultaneously-produced-arpeggio-tone-number selection signal BO is produced by the key coder 11. The switch 12M is to select a tone pitch increase pattern (up mode) or a tone pitch increase and decrease repetition pattern/-(turn mode) in an automatic arpeggio performance. In response to the operation of the switch 12M, the key coder 11 provides an up/turn selection signal UT. A channel processor 14 comprises a timing signal generating circuit 17 adapted to control the operation timing of the circuits in the channel processor 14, a tone production assignment circuit 15 and an automatic arpeggio circuit 16.

In the electronic musical instrument according to the embodiment of the invention, there are provided a particular number of (for instance, fifteen) channels to which tones concerning the data (key codes $N_1$-$B_3$) representative of key depression are assigned, the data being supplied from the key coder 11, and three exclusive tone production channels to which automatic arpeggio tones are exclusively assigned; that is, there are provided eighteen tone production channels in total.

The tone production assignment circuit section 15 operates to assign the production of tones, each which is specified by a key code $N_1$-$B_3$ from the key coder 11, to available one of the depressed-key assigning channels. Furthermore, the tone production assignment circuit section 15 operates to assign a tone, which is specified by an automatic arpeggio tone key code consisting of six bits: $AB_2$, $AB_1$, $AN_4$, $AN_3$, $AN_2$ and $AN_1$ from the automatic arpeggio circuit 16, to one of the automatic arpeggio exclusive tone production channels. Hereinafter, the assignment operation to the depressed-key assigning channels in response to a key code $N_1$-$B_3$ from the key coder 11 will be referred to as "ordinary assignment operation" when applicable.

A musical tone generating device 18 is so designed as to generate musical tones separately according to the tone production channel, so that tones assigned to the tone production channels by the tone production assignment circuit section 15 are produced. The musical tone generating device 18 may be of a suitable arrangement that tones assigned to the tone production channels are read out, in time division manner, of a musical tone waveform memory, or digital tone generators are juxtaposed in correspondence to the tone production channels, respectively.

In the tone production assignment circuit section 15, a key code memory circuit 19 has a particular number of (for instance eighteen) memory positions corresponding to the number of tone production channels, and has gate means on the input side thereof. As a result of the "ordinary assignment operation", a key code $N_1$-$B_3$ from the key coder 11 is stored in one of the memory positions, which corresponds to the depressed-key assigning channel of the key code memory circuit 19.

The various circuits in the tone production assignment circuit section 15 operate mainly for "ordinary assignment operation". A key code comparison circuit 20 compares bit by bit a key code $B_3$, $B_2$, $B_1$, $N_4$, $N_3$, $N_2$, $N_1$ from the key coder 11 with a key code $B_3$*, $B_2$*, $B_1$*, $N_4$*, $N_3$*, $N_2$*, $N_1$* which has been assigned to the depressed-key assigning channel and stored in the key code memory circuit 19. The comparison circuit 20 outputs comparison outputs EQ depending on whether the two key codes coincide with each other or not. An assignment control section 21 detects whether or not predetermined assignment conditions are satisfied, and when satisfied, outputs a load signal LD to store the input key code $N_1$-$B_3$ in the key code memory circuit 19. As a result, a new tone production assignment operation is effected. The assignment control section 21 produces a key-on signal KO indicating the fact that a key assigned to the respective channel is being depressed. A truncate circuit 22 is to detect the channel to which a key released earliest is assigned, and provides a truncate channel designation signal TR in response to this detection. The assignment control section 21 operates to cancel the old assignment to a channel which is represented by the truncate channel designation signal TR, and to assign a newly depressed key to that channel.

The automatic arpeggio circuit 16 operates to generate the information (arpeggio key code $AN_1$-$AB_2$) of tones which should be produced in an automatic arpeggio exclusive tone production channel, according to the information (i.e. the output key codes $N_1$*-$B_3$* of the key code memory circuit 19) of the tones which have been assigned to depressed-key assignment channels. More specifically, the automatic arpeggio circuit 16 selects one after another only the key codes concerning the lower keyboard key depressions from among the key codes $N_1$*-$N_3$* stored in the key code memory circuit 19, and provides automatic arpeggio key codes $AN_1$-$AB_2$ based on the key code $N_1$*-$B_3$* thus selected. The automatic arpeggio key code $AN_1$-$AB_2$ is supplied to the key code memory circuit 19 as if the key concerning the key code $AN_1$-$AB_2$ were depressed, and is stored in one of the memory positions, corresponding to the arpeggio exclusive tone production channel, of the key code memory circuit 19. Accordingly, in the automatic arpeggio exclusive tone production channel of the musical tone generating device 18, a tone corresponding to the key code $AN_1$-$AB_2$ is produced. With respect to the generation pattern of automatic arpeggio key codes $AN_1$-$AB_2$, an arpeggio pattern signal consisting of four bits: $AP_4$, $AP_3$, $AP_2$ and $AP_1$ is provided by a pattern generator 23, and an arpeggio pattern selected with the pattern selector 24 by the performer is produced by the generator 23.

Figure 2:
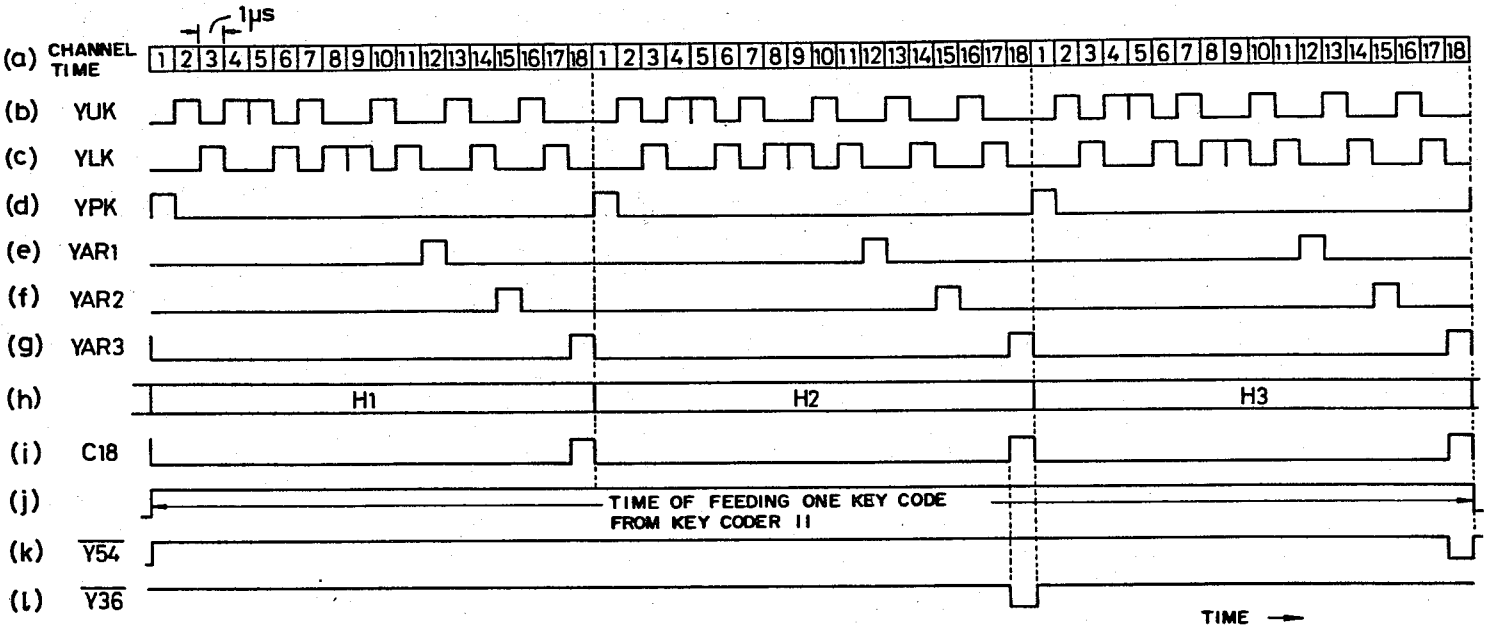
FIG. 2 is a time chart indicating the relations in time between various signals used in a tone production assignment circuit section in FIG. 1.

In the tone production assignment circuit section 15, the tone production channels are formed in time division manner. The time-divided time slots of the channels are segregated from one another with the timing of main clock pulses $\phi$. In this embodiment, the period of the main clock pulses is 1 $\mu$s. The part (a) of FIG. 2 shows the time slots (channel times) of the channels. Eighteen (18) time slots each having a time width of 1 $\mu$s correspond to the first through eighteenth channels, respectively.

In the embodiment, the tone production channels are provided separately for the keyboards, and the tone production assignment circuit section 15 operates to assign keys depressed in a certain keyboard to the available ones of those tone production channels prodetermined to such a certain keyboard. More specifically, upper keyboard tones are assigned to any of the 2nd, 4th, 5th, 7th, 10th, 13th and 16th channels, lower keyboard tones are assigned to any of the 3rd, 6th, 8th, 9th, 11th, 14th, and 17th channels. A pedal keyboard tone is assigned to the first (1st) channel. The 12th, 15th and 18th are used exclusively for automatic arpeggio tones. Signals representative of these respective keyboards channels and the automatic arpeggio exclusive channels are provided by the timing signal generating circuit 17.

Examples of the signals representative of the channels and provided by the timing signal generating circuit 17 are shown in the parts (b) through (g) of FIG. 2, in which reference characters YUK, YLK and YPK designate the signals representative of the upper keyboard channels, the lower keyboard channnels, and the pedal keyboard channel, respectively, and $YAR_1$, $YAR_2$ and $YAR_3$, the signals representative of the three automatic arpeggio exclusive channels, respectively.

One cycle of processing operation of the channel processor 14 is carried out for three cylces (54 $\mu$s) of the time division channel times indicated in the part (a) of FIG. 2. In the part (h) of FIG. 2, reference characters H1, H2 and H3 designate the first 18 $\mu$s (the first processing period), the second 18 $\mu$s (the second processing period) and the third 18 $\mu$s (the third processing period) in one operation cycle of 54 $\mu$s, respectively. The timing signal generating circuit 17 provides the last channel signal C18 (the part (i) of FIG. 2) at the last time slot of each of the periods H1, H2 and H3, i.e. every 18th channel time slot. In addition to the signals shown in FIG. 2, various timing signals are provided by the timing signal generating circuit 17.

Description of the key coder 11

It is preferably that a key coder described in the specification of U.S. Pat. No. 4,148,017 is employed as the key coder 11. The key coder 11 outputs a key code consisting of seven bits: $B_3$, $B_2$, $B_1$, $N_4$, $N_3$, $N_2$ and $N_1$ representative of a key depressed in the keyboard section 10. Whenever a key is depressed, the key code $N_1$-$B_3$ is outputted with a predetermined time width and in time division manner. The predetermined time width is the sum (54 $\mu$s) of the three periods H1, H2 and H3, as indicated in the part (j) of FIG. 2.

Each key code $N_1$-$B_3$ is a 7-bit data consisting of a block code $B_3$, $B_2$, $B_1$ representative of an octave range, and a note code $N_4$, $N_3$, $N_2$, $N_1$ representative of a note within an octave. One example of the relation between the contents of note codes and the notes is as indicated in the following Table 1:

TABLE 1

| Tone | $N_4$ | $N_3$ | $N_2$ | $N_1$ | Decimal notation |
|---|---|---|---|---|---|
| C# | 0 | 0 | 0 | 1 | 1 |
| D | 0 | 0 | 1 | 0 | 2 |
| D# | 0 | 0 | 1 | 1 | 3 |
| E | 0 | 1 | 0 | 1 | 5 |
| F | 0 | 1 | 1 | 0 | 6 |
| F# | 0 | 1 | 1 | 1 | 7 |
| G | 1 | 0 | 0 | 1 | 9 |
| G# | 1 | 0 | 1 | 0 | 10 |
| A | 1 | 0 | 1 | 1 | 11 |
| A# | 1 | 1 | 0 | 1 | 13 |
| B | 1 | 1 | 1 | 0 | 14 |
| C | 1 | 1 | 1 | 1 | 15 |

One example of the relation between the contents of block codes and the octave ranges is as indicated in the following Table 2:

TABLE 2

| | | | Octave range | | | |
|---|---|---|---|---|---|---|
| $B_3$ | $B_2$ $AB_2$ | $B_1$ $AB_1$ | Upper keyboard | Lower keyboard | Pedal keyboard | Arpeggio |
| 0 | 0 | 0 | C3 | C2 | C2 | |
| 0 | 0 | 1 | C#3~C4 | C#2~C3 | C#2~C3 | C#2~C3 |
| 0 | 1 | 0 | C#3~C5 | C#3~C4 | C#3~C4 | C#3~C4 |
| 0 | 1 | 1 | C#5~C6 | C#4~C5 | | C#4~C5 |
| 1 | 0 | 0 | C#6~C7 | C#5~C6 | | C#5~C6 |

As is apparent from Table 2, the relation between the block code $B_1$-$B_3$ and the octave range depends on the keyboards. For instance, the key range of the upper keyboard is from C3 to C7; that is, notes lower than C3 and higher than C7 are not used. The key range of the lower keyboard is from C2 to C6. Therefore, even with the same block code $B_1$-$B_3$, the actual octave range of the upper keyboard is different by one octave from that of the lower keyboard. Furthermore, the octave range to which one and the same block code $B_1$-$B_3$ is applied is not the ordinary range of from C to B, but the arange of from C# to higher C. Accordingly, the block code $B_3$, $B_2$, $B_1$=0 0 0 for the lowest range is applied to only one note C which is the lowest one. Indicated in the column "Arpeggio" of Table 2 are ranges corresponding to the contents of the block code $AB_2$, $AB_1$ which is included in an automatic arpeggio key code $AN_1$-$AB_2$ which is provided by the automatic arpeggio circuit 16 (FIG. 1). The range indicated in the column "Arpeggio" are substantially similar to those of the block codes $B_1$-$B_3$ for the lower keyboard, except that note $C_2$ in the lowest range is not used in automatic arpeggio. Accordingly, in the arpeggio block code $AB_2$, $AB_1$, a bit corresponding to the third bit $B_3$ is unnecessary. The key range of the pedal keyboard is from $C_2$ to $C_4$. Therefore, in this case also, data for the third bit $B_3$ is unnecessary.

In response to a key code $N_1$-$B_3$, the key coder 11 outputs a keyboard signal U, L or P with a time width of 54 μs which represents a keyboard to which the key represented by the key code $N_1$-$B_3$ belongs. The keyboard signals U, L and P represent the upper keyboard, the lower keyboard and the pedal keyboard, respectively.

A key code $N_1B_3$ and its keyboard signal U, L or P are repeatedly produced at suitable time intervals by the key coder 11. When the key is released, the production of the key code $N_1$-$B_3$ is stopped. In order to detect which one of the key codes $N_1$-$B_3$ which have been provided relates to the released key, a key-off detection signal X is periodically generated by the key coder 11. The generation timing of the key-off detection signal X is equal to the one key code delivery time (54 μs) indicated in the part (j) of FIG. 2. When the signal X is being generated, none of the key code $N_1$-$B_3$ and keyboard signal U, L or P is generated. The generation interval of the key-off detection signal X is of the order of 5 ms, which is a relatively long period of time for a digital system, but is so short for the sense of hearing that the person cannot recognize the delay of the process by the signals X.

The assignment control section 21 in the tone production assignment circuit section 15 is so designed, that, under the condition that a key code $N_1$-$B_3$ which has been supplied to the channel processor 14 is not supplied to the latter 14 during one generation period of the key-off detection signal X, the assignment control section 21 decides that the key relating to that key code $N_1$-$B_3$ has been released.

In the embodiment, the key coder 11 delivers not only the above-described data ($N_1$-$B_3$, U, L, P and X) concerning the keys, but also digital data which are selected by musical tone controlling and various function selecting switches. In the case where automatic arpeggio performance has been selected, three automatic arpeggio selection signals AR1, AR2 and AR3 are successively delivered out by the key coder 11. The time interval of delivering the signals AR1, AR2 and AR3 is equal to one key code delivery time (54 μs) as indicated in the part (j) of FIG. 2. When the automatic arpeggio selection signals AR1, AR2 and AR3 are being delivered out, no data ($N_1$-$B_3$, U, L, P and X) concerning keys are delivered. Similarly as in the key-off detection signal X, the automatic arpeggio selection signals AR1, AR2 and AR3 are repeatedly generated, and the repetitive period is of the order of from 1 ms to 5 ms.

When the automatic arpeggio selection signals AR1, AR2 and AR3 are being delivered, the tone production assignment circuit section 15 is utilized for automatic arpeggio assignment. That is, instead of the key code $N_1$-$B_3$ from the key coder 11, a key code $AN_1$-$AB_2$ representative of an automatic arpeggio tone is supplied to the key code memory circuit 19. This will be described in detail later.

A memory signal MM representative of the requirement that data concerning a depressed key should be stored even after the key is released, and the data should be used for musical tone generation, is produced by the key coder 11 in response to the switch operation effected by the performer.

Description of the tone production assignment circuit section 15

One example of the tone production assignment circuit section 15 will be partially described with reference to FIGS. 3 and 4.

Figure 3:
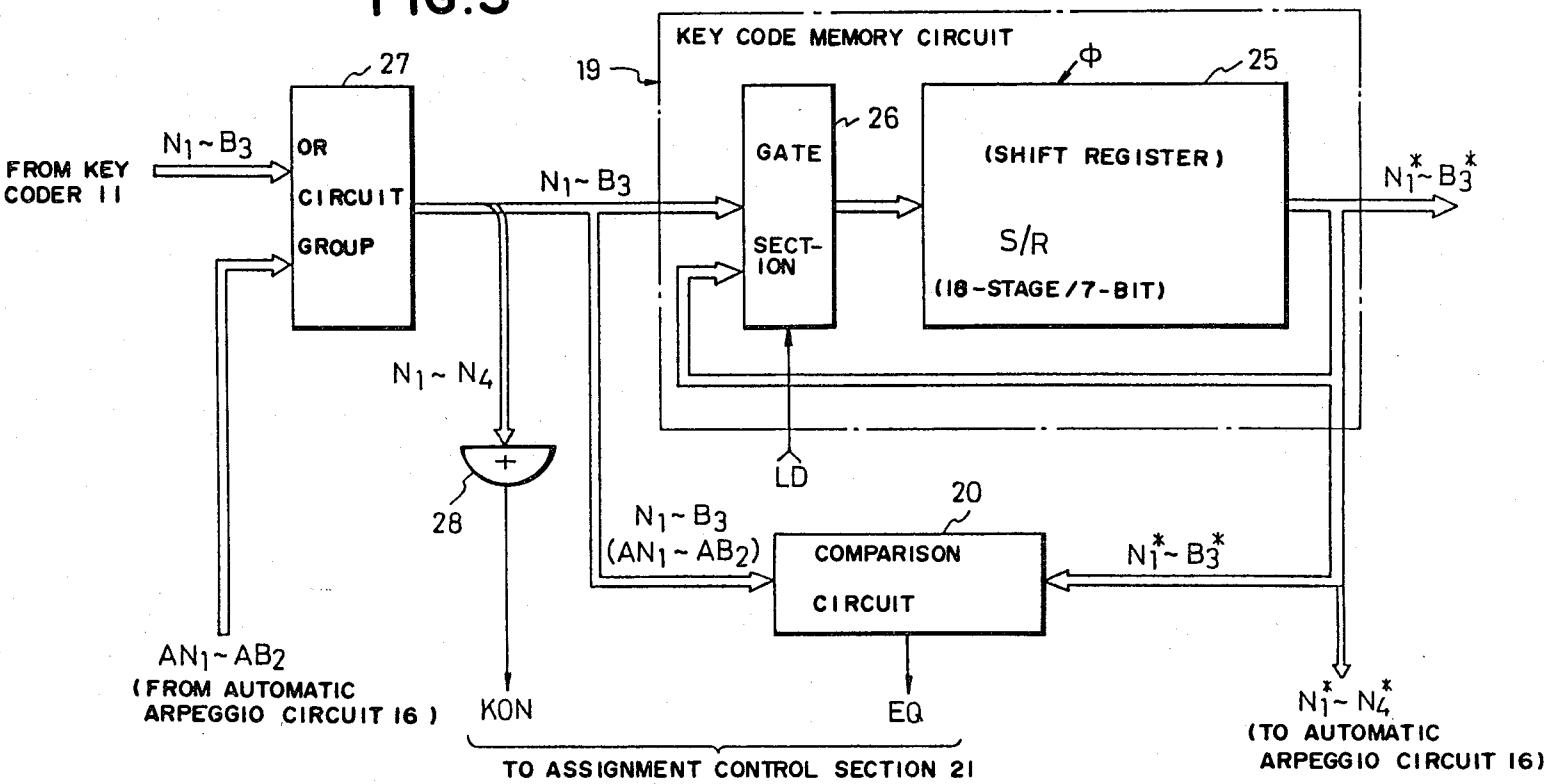
FIG. 3 is a block diagram showing in detail a key code memory circuit in FIG. 1 and circuits surrounding it.

In FIG. 3, the key code memory circuit 19 comprises: an 18-stage/7-bit shift register 25 and a gate section 26. Upon reception of a load signal LD, the gate section 26 loads a key code $N_1$-$B_3$ (or $AN_1$-$AB_2$) which is supplied through an OR circuit group 27 thereto, in the shift register 25. When the load signal LD is not applied, the output **N1*-B3* of the shift register is circulated. A key code $N_1$-$B_3$ from the key coder 11 and an automatic arpeggio key code $AN_1$-$AB_2$ from the automatic arpeggio circuit 16 are applied to the OR circuit group 27, and one of the key codes is outputted by the OR circuit group. The ntoe code $N_1$, $N_2$, $N_3$, $N_4$ (or $AN_1$-$AN_4$) of the key code $N_1$-$B_3$ (or $AN_1$-$AB_2$) outputted by the OR circuit group 27 is applied to an OR circuit 28. The output of the OR circuit 28 is applied, as a key code detection signal KON, to an assignment control section 21 (FIG. 4). The fact that the signal KON is at "1" means that a key code is applied to the input of the key code memory circuit 19**.

The shift register 25 carried out its shifting operation in response to the main clock pulse $\phi$ every 1 μs. The number of stages in the shift register 23 corresponds to the total number of tone production channels. The key codes $N_1$*-$B_3$* of tones assigned to the channels are stored, in time division manner, in the stages of the shift register 25, respectively. These key codes $N_1$*-$B_3$* are successively outputted by the key code memory circuit 19 in synchronization with the channel times each having a time width of 1 μs (the part (a) of FIG. 2), and are applied to one input side of a comparison circuit 20, to the other input side of which the key code $N_1$-$B_3$ from the OR circuit group 27 is applied.

In the comparison circuit 20, the key code $N_1$-$B_3$ of a depressed key which is maintained unchanged for 54 μs is compared with an assigned key code $N_1$*-$B_3$* which varies every microsecond (μs). In the case where the same key code $N_1$*-$B_3$* as the key code $N_1$-$B_3$ has been stored in the memory circuit 19 already, the comparison output EQ is raised to "1" in synchronization with that channel time.

*Generation of a new key-on signal NKO

Figure 4:
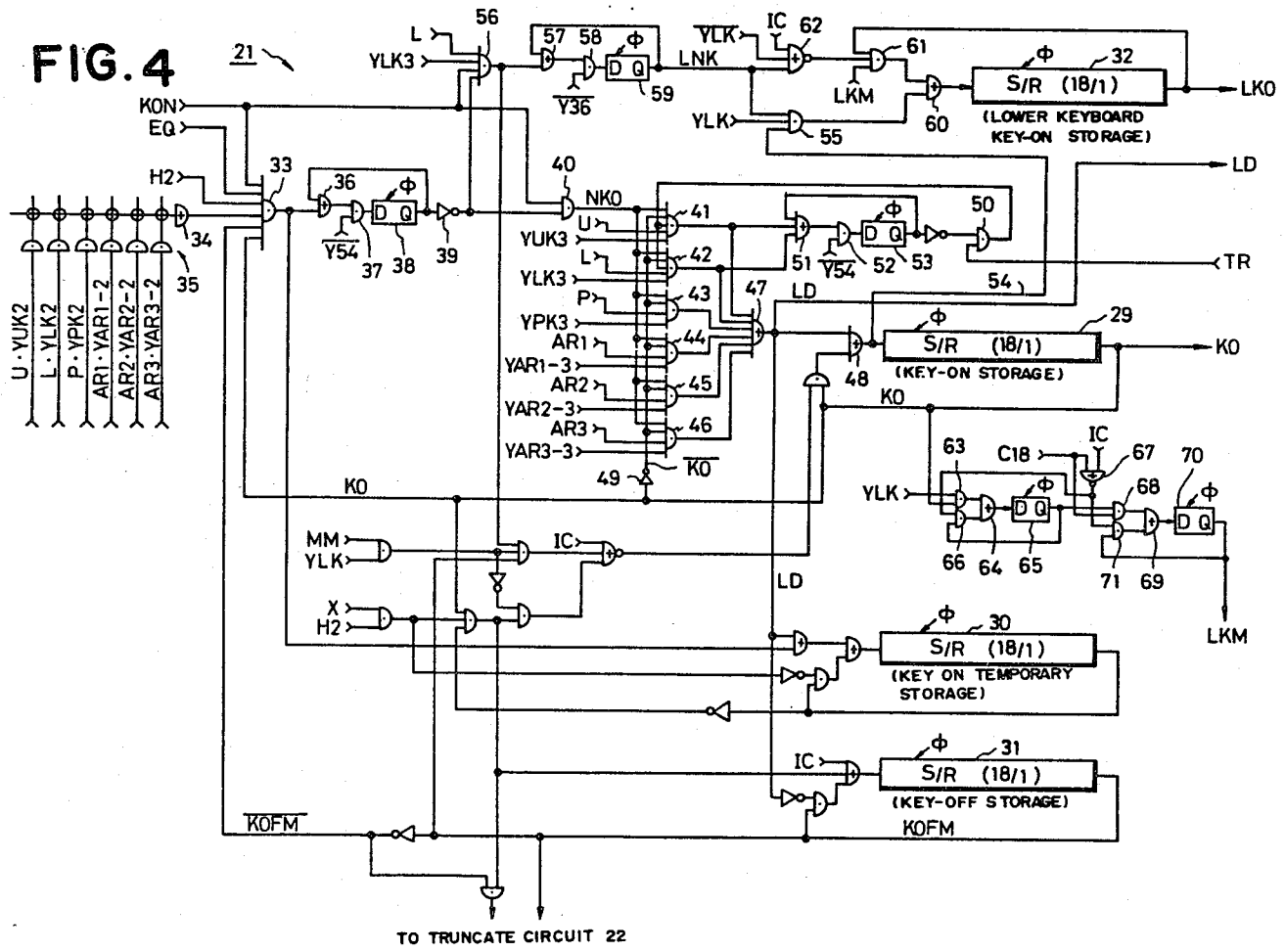
FIG. 4 is a circuit diagram showing details of an assignment control section in FIG. 1.

In FIG. 4, the assignment control section 21 comprises: a key-on storing shift register 29; a key-on temporarily storing shift register 30; a key-off storing shift register 31; a lower keyboard key-on storing shift register 32; and circuits for controlling the loading of data into these registers and the holding of data in them. When a key concerning a key code $N_1$*-$B_3$* which is assigned and stored in the key code memory circuit 19 is being depressed, the key-on storing shift register 29 stores a signal "1" (a key-on signal KO) in synchronization with the assignment channel. Accordingly, the tone assignement has been done to the channel for which the output of the shift register is "1", and the key of the tone is being depressed.

If a key is depressed even once in one generation period of the key-off inspection signal X, a signal "1" is stored in the key's assignment channel, in the key-on temporarily storing shift register. In the key-off storing shift register, a signal "1" is stored in a channel concerning a key released. The last stage of the shift register 31 outputs a key-off memory signal KOFM. With respect to the above-described shift register 29, 30 and 31, the memory signal MM, the lower keyboard channel signal YLK (FIG. 2,(c)) the key-off inspection signal X, a signal representative of the second processing period H2, and an initial clear signal IC provided when the power switch is turned on, are inputted as indicated in FIG. 4. However, this will not described in detail, because it is not so important for this invention (if necessary, refer to the aforementioned prior Patent publications).

The comparison output EQ of the comparison circuit 20 is applied to one of the six input terminals of an AND circuit 33 (FIG. 4). Applied to the remaining input terminals of the AND circuit 33 are the key code detection signal KON of the OR circuit 28 (FIG. 3), the signal representative of the second processing period H2 (cf. FIG. 2), the output of an OR circuit 34, the key-on signal KO of the shift register 29, the inversion signal $\overline{KOFM}$ of the key-off memory signal KOFM. The OR circuit 34 is applied with the outputs of six AND circuits 35 which are two-input type AND circuits receiving input signals as indicated in FIG. 4. In this connection reference character YUK2 designates the upper keyboard channel signal YUK which is provided during the second processing period H2 only. Similarly, reference characters YLK2, YPK2, YAR1-2, YAR2-2 and YAR3-2 designate the lower keyboard channel signal YLK, the pedal keyboard channel signal YPK, and the automatic arpeggio exclusive channel signals YAR1, YAR2 and YAR3 (cf. FIG. 2) which are provided during the second processing period H2 only, respectively. Furthermore, reference characters U, L, P, AR1, AR2 and AR3 designate respectively signals each having a time width of 54 μs, which are provided by the key coder 11 as described before, these signals indicating a keyboard or automatic arpeggio channel for which assignment should be done.

Satisfaction of the condition of the AND circuit 33 in the time slot of a channel means that the same key code as a depressed key's key code $N_1$-$B_3$ or an automatic arpeggio key code $AN_1$-$AB_2$ which is applied to the input side of the key code memory circuit 19 has been assigned to that channel and the key is being depressed (or the key code $N_1$-$B_3$ or $AN_1$-$AB_2$ is being applied). The output of the AND circuit 33 is applied through an OR circuit 36 and an AND circuit 37 to a delay flip-flop 38, where it is stored and held. When the AND circuit 37 is disabled by a signal $\overline{Y54}$ (FIG. 2, (k)) which is set to "0" only for the last channel time of the third processing period H3 and is maintained at "1" for the remaining period, the memory holding operation of the delay flip-flop is released. Accordingly, when the condition of the AND circuit 33 is satisfied, the output of the delay flip-flop 38 is maintained at "1" for the third processing period H3; and when the condition is not satisfied, the output is at "0". The output of the delay flip-flop 38 is applied through an inverter 39 to one input terminal of an AND circuit 40.

Applied to the other input terminal of the AND circuit 40 is the key code detection signal KON of the OR circuit 28. The output "1" of the AND circuit 40 is the new key-on signal NKO. That is, the new key-on signal NKO is provided (being "1") when the key code $N_1$-$B_3$ (or $AN_1$-$AB_2$) applied to the input side of the key code memory circuit 19 is not assigned to any of the channels yet.

The new key-on signal NKO outputted by the AND circuit 40 is applied to AND circuit 41 through 46, and is selected in synchronization with a single channel time, as a result of which it is applied through OR circuits 47 and 48 to the key-on storing shift register 29, where it is stored. The output "1" of the OR circuit 47 is employed as a load signal LD. The key coder 11 applies the upper keyboard signal U, the lower keyboard signal L, the pedal keyboard signal P, and the automatic arpeggio selection signals AR1, AR2 and AR3 to the AND circuits 41 through 46, respectively, and one of the AND circuits 41 through 46 is enabled which corresponds to the keyboard (or automatic arpeggio function) to which a key code $N_1$-$B_3$ (or $AN_1$-$AB_2$) being supplied at present belongs. Furthermore, signals YUK3, YLK3, YPK3, YAR1-3, YAR2-3 and YAR3-3 representing the keyboard and automatic arpeggio exclusive channels are applied to the AND circuits 41 through 46, respectively. These signals YUK3, YLK3, YPK3, YAR1-3, YAR2-3 and YAR3-3 are the exclusive channel signals YUK, YLK, YPK, YAR1, YAR2 and YAR3 (FIG. 2, (*b*)-(*g*)) which are produced only in the third processing period H3 shown in the part (h) of FIG. 2. In addition, a signal $\overline{KO}$ obtained by applying the key-on signal KO of the shift register 29 to an inverter 49 is applied to the AND circuits 41 through 46.

*Ordinary assignment operation

Seven upper keyboard tone exclusive channels and seven lower keyboard tone exclusive channels are provided as described before. Therefore, a truncate channel designation signal TR is used to assign a new key-on signal NKO to a single channel. The signal TR is provided by a truncate circuit 22. The truncate channel designation signal TR is provided in synchronization with the assignment channel time of the key which has been released earliest in the upper keyboard and the assignment channel time of the key which has been released earlier in the lower keyboard among the tones which are being assigned. This truncate circuit 22 may be formed in accordance with a truncate circuit which is disclosed in the specification of U.S. Pat. No. 4,192,211, now U.S. Pat. No. 4,192,211 assigned to the same assignee as this case, entitled "Electronic Musical Instrument". The truncate channel designation signal TR is applied through an AND circuit 50 to the AND circuits 41 and 42, so that the new key-on signal NKO is selected in a single channel time concerning the relevant keyboard. When a signal "1" is outputted by the AND circuit 41 or 42 once, the signal "1" is applied through an OR circuit 51 and an AND circuit 52 to a delay flip-flop 53, where it is stored. This storage is self-held by the signal $\overline{Y54}$ applied to the AND circuit 52, until the last channel time of one processing cycle. The output "1" of the delay flip-flop 53 is applied through an inverter to the AND circuit 50 thereby to disable the latter 50. Accordingly, the condition of the AND circuit 41 or 42 is satisfied only once in the third processing period H3 in which the new key-on signal NKO has been provided.

The signal "1" outputted by the AND circuit 41 or 42 is applied, as the load signal LD, to the key code memory circuit 19 (FIG. 3) through the OR circuit 47, and it is further applied though the OR circuit 48 to the shift register 29, where it is stored.

The number of pedal keyboard tone channel is only one. Therefore, if the new key-on signal NKO is provided when the pedal keyboard signal P is being supplied, then the AND circuit 43 outputs a signal "1" in the first channel time of the third processing period H3 in response to the signal YKP3. The output of the AND circuit 43 is applied to the OR circuit 47 to provide the load signal LD.

*Automatic arpeggio assignment

Three automatic arpeggio exclusive channels are provided. Depending on the automatic arpeggio selection signal (AR1, AR2 or AR3) supplied by the key coder 11, the channel to which an automatic arpeggio tone should be assigned is determined. That is, as is clear from the combination of the inputs to the AND circuits 44, 45 and 46, when the signal AR1 is applied, the condition of the AND circuit 44 is satisfied by the signal YAR1-3 in the time slot of the 12th channel is the third processing period H3 (cf. FIG. 2). Next, when the signal AR2 is applied, the condition of the AND circuit 45 is satisfied by the signal YAR2-3 in the time slot of the 15th channel. When the signal AR3 is applied, the condition of the AND circuit 46 is satisfied by the signal YAR3-3 in the time slot of the 18th channel. The outputs of these AND circuits 44, 45 and 46 are applied to the OR circuit 47, to provide the load signal LD.

*Generation of the lower keyboard key-on signal LKO

In this embodiment, automatic arpeggio forming tones are specified by the lower keyboard. For this purpose, the lower keyboard key-on signal LKO generated by a lower keyboard key-on storing shift register 32 is utilized in the automatic arpeggio circuit 16.

The lower keyboard key-on storing shift register 32 operates to store depression of the lower keyboard's keys which are assigned to the respective tone production channels. Even after the lower keyboard's keys were released, the shift register 32 holds the memories as if the lower keyboard's keys were still being depressed. If lower keyboard's keys depressed for automatic arpeggio performance are irregularly released, then the performance is adversely affected. In order to prevent this difficulty, the shift register 32 is provided.

When a key is depressed newly in the lower keyboard, the shift register 32 selects and stores one, corresponding to the lower keyboard exclusive channel, of the key-on signals KO which are stored in the key-on storing shift register 29. The output (key-on signal KO) of the OR circuit 48 is applied to one input terminal of an AND circuit 55 through a line 54, to another input terminal of which the signal YLK is applied. Accordingly, when the lower keyboard key-on signal KO is loaded (or stored and circulated) in the shift register, the AND circuit 55 is enabled. A lower keyboard new key-on signal LNK representative of the fact that a key is newly depressed in the lower keyboard is applied to another input terminal of the AND circuit 55. The output of the above-described inverter 39 and the key code detection signal KON are applied to input terminals of an AND circuit 56, to the remaining input terminals of which the lower keyboard signal L and the signal YLK3 representative of a lower keyboard exclusive channel in the third processing period (H3) are applied. Accordingly, when a key is newly depressed in the lower keyboard, then the output of the AND circuit 56 is raised to "1" in synchronization with a lower keyboard exclusive channel in the third processing period (H3) only once at the beginning of the depression of the key.

The output of the AND circuit 56 is applied though an OR circuit 57 and an AND circuit 58 to a delay flip-flop 59 where it is held until the second processing period H2 is ended, because a signal $\overline{Y36}$ (FIG. 2, (1) which is set to "0" only in the last time slot of the second processing period H2 is applied to the other input terminal of the AND circuit 58. Accordingly, the output of the delay flip-flop 59 is maintained at "1" from the third processing period H3 to the following second processing period H2 only when a key is newly depressed in the lower keyboard, the output being applied, as the signal LNK, to the AND circuit 55. As a result, the output of the AND circuit 55 is raised to "1" in synchronization with the assignment channel of a key being depressed in the lower keyboard. This output "1" is applied through the OR circuit 60 to the lower keyboard key-on storing shift register 32, where it is stored. The lower keyboard key-on signal LKO is self-held by means of the AND circuit 61 and the OR circuit 60. The output of a NOR circuit 62 is applied to the AND circuit 61. The AND circuit 61 is disabled when the initial clear signal IC is generated, or in the channel times other than the lower keyboard exclusive channel times (the signal $\overline{YKL}$ being at "1") or when the lower keyboard new key-on signal LNK is provided. Applied to the other input terminal of the AND circuit 61 is a lower keyboard key depression memory signal LKM which is continuously maintained at "1" when a key in the lower keyboard is being depressed. Accordingly, when a key in the lower keyboard is being depressed, the lower keyboard key-on storing shift register 32 can be self-held. In other words, when any key in the lower keyboard is being depressed even if a key in the lower keyboard is released, the memory of the shift register concerning the channel to which the released key is assigned is not released, and the lower keyboard key-on signal LKO is provided as if the key were being depressed. However, as was described before, when a key is newly depressed in the lower keyboard, a lower keyboard key-on signal LNK is produced, whereby the memory in the lower keyboard key-on storing register 32 is rewritten. That is, the lower keyboard's key-on signal KO in the shift register 29 is transferred to the shift register 32, and the lower keyboard key-on signal LKO is stored therein in correspondence to the lower-keyboard exclusive channel of the key which is actually depressed.

*Generation of the lower keyboard key depression memory signal LKM

The lower keyboard key depression memory signal LKM can be obtained by selectively storing one, corresponding to a lower keyboard exclusive channel, among the key-on signals KO which are provided in time division manner by the shift register 29. The lower keyboard exclusive channel signal YLK is applied to one input terminal of an AND circuit 63, and the AND circuit 63 is enabled only in the lower keyboard exclusive channel times (FIG. 2, (c)). The key-on signal KO is applied to the other input terminal of the AND circuit 63. Only the key-on signal KO concerning the lower keyboard is selected by the AND circuit 63, and is applied through an OR circuit 64 to a delay flip-flop 65. The output of the delay flip-flop 65 is self-held by means of an AND circuit 66. The AND circuit 66 is disabled by the output "0" of a NOR circuit 67, to which the initial clear signal IC and the last channel signal C18 are applied. Accordingly, the AND circuit 66 is disabled at the 18th channel time the last channel signal C18 is provided, so that the self-holding state of the delay flip-flop 65 is released.

The output of the delay flip-flop 65 is applied to an AND circuit 68, which is enabled by the aforementioned last channel signal C18. Accordingly, the memory of the flip-flop 65 is loaded through the AND circuit 68 and an OR circuit 69 into a delay flip-flop 70 immediately before the self-holding state is released. The output of the delay flip-flop 70 is self-held by means of an AND circuit 71 and the OR circuit 69. The AND circuit 71 is disabled by the output "0" of the NOR circuit 67. Accordingly, whenever the 18th channel time, in which the last channel signal C18 is provided, occurs, the self-holding state of the delay flip-flop 70 is released. If the signal "1" is provided by the delay flip-flop 65 in the time slot of the 18th channel, it is stored in the delay flip-flop 70 again, and the memory is self-held until the next last channel signal C18 is provided. Thus, when a key is being depressed in the lower keyboard (or a note is assigned to a lower keyboard exclusive channel), the output of the delay flip-flop 70 is maintained at "1". The output "1" of the delay flip-flop 70 is used as the lower keybard depression memory signal LKM.

Description of the automatic arpeggio circuit 16

A detailed example of the automatic arpeggio circuit 16 is as shown in FIG. 5. The automatic arpeggio circuit 16 is different from that of the preceding Patent Application (U.S. Patent Application Ser. No. 952,098) now U.S. Pat. No. 4,217,804 in that a plurality of arpeggio tones can be produced simultaneously, and in the example shown in FIG. 5 three tones can be produced at the same time.

Figure 6:
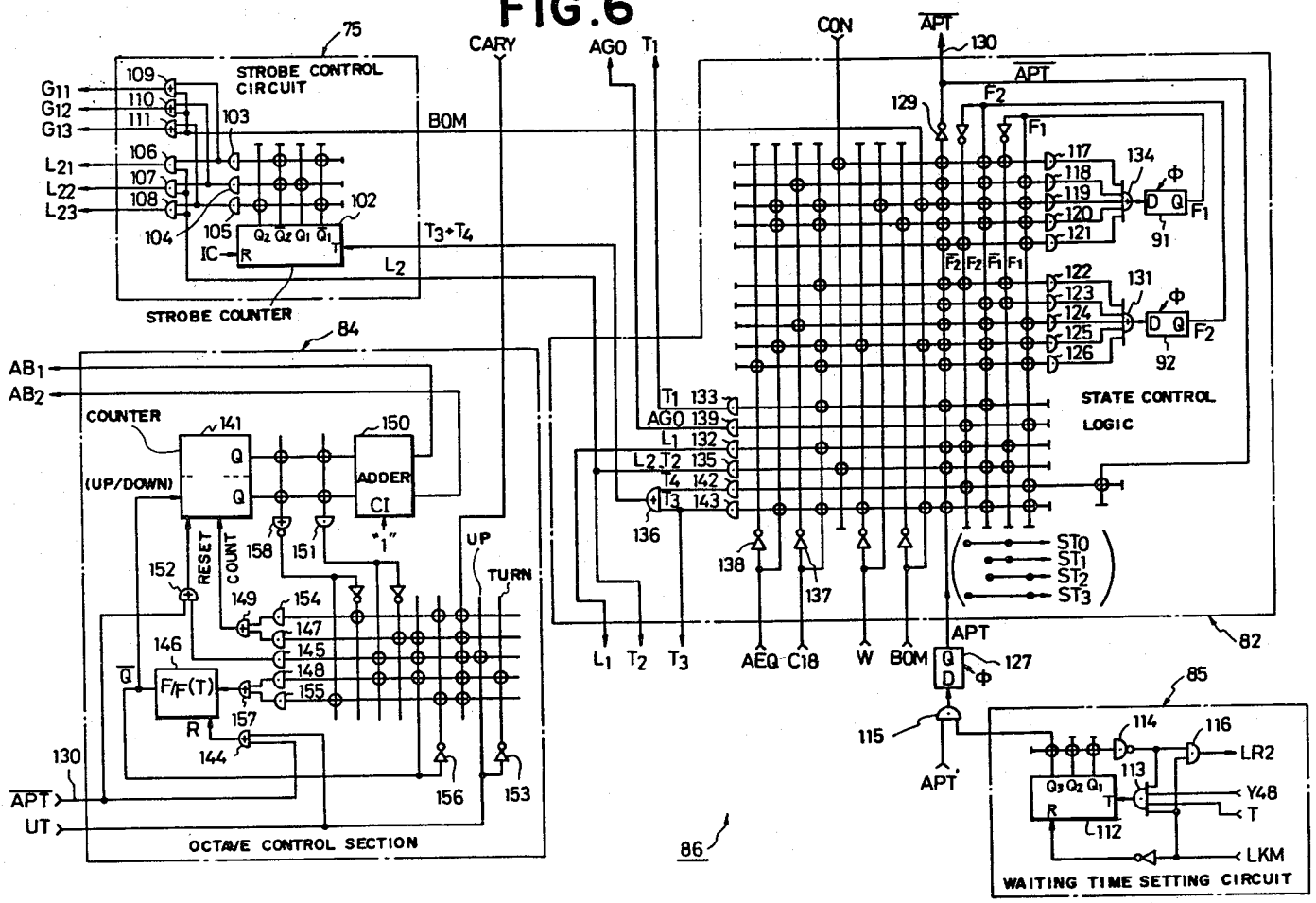
FIG. 6 is a circuit diagram showing details of a circuit 86 in FIG. 5, which comprises a state control logic, a strobe control circuit, an octave control section, and a waiting time setting circuit.

In the automatic arpeggio circuit 16, it is made possible to produce a plurality of tones simultaneously by a plurality of (three in the example) output registers 72, 73, and 74, a strobe control circuit 75 for controlling the registers 72, 73 and 74, an adder 78 inserted between an arpeggio pattern register 76 and a comparator 77, and a simultaneous tone-production-number control circuit 79 for controlling the operation of the adder 78 in response to an arpeggio simultaneous tone-production number selection signal BO. In addition these elements, the automatic arpeggio circuit 16 comprises: a note counter 80, a comparator 81 for subjecting note codes $N_1$*-$N_4$* to comparison, a state control logic 82, a tone-number counter 83, an octave control section 84, and a waiting time setting circuit 85. For convenience in illustration, the details of a circuit means 86 including the strobe control circuit 75, state control logic 82, octave control section 84 and waiting time setting circuit 85 is shown in FIG. 6 instead of FIG. 5.

*Outline of the automatic arpeggio circuit 16

Among the key codes $N_1$*-$B_3$* stored in the channels of the key code memory circuit 19, the note codes $N_1$*-$N_4$* are inputted into the automatic arpeggio circuit 16. Among these note codes $N_1$*-$N_4$*, note codes (generated in the 3rd, 6th, 8th, 9th, 11th, 14th and 17th channel times) corresponding to a plurality of keys depressed in a particular keyboard (for instance the lower keyboard) are selected one after another according to the arpeggio pattern. Then, the octave information corresponding to the arpeggio pattern is given to the note code $N_1$*-$N_4$* thus selected (the block code $AB_1$, $AB_2$ being given thereto). Thus, the automatic arpeggio tones' key codes $AN_1$-$AB_2$ are provided. The automatic arpeggio tones' key codes $AN_1$-$AB_2$ thus provided are selected by an AND circuit group 87, 88 or 89, and are delivered to the key code memory circuit (which is the OR circuit group 27 in FIG. 3) as if keys corresponding to the key codes $AN_1$-$AB_2$ were being depressed, as a result of which they are stored in the respective channels of the key code memory circuit 19 as described before.

Selection of the note codes $N_1$*-$N_4$* of the notes which have been assigned to the lower keyboard exclusive channels already are effected by utilizing the comparator 81. In the comparator 81, a note code $N_1$*-$N_4$* from the key code memory circuit 19 and a count value of the 4-bit binary counter (note counter) 80 are subjected to comparison, and when both are coincident with each other, a coincidence signal COIN is outputted. The counter 80 carries out up-count by being controlled by the state control logic 82. The coincidence signal COIN outputted by the comparator 81 is applied to an AND circuit 90, and a coincidence signal COIN provided for a lower keyboard exclusive channel is selected by the lower keyboard key-on signal LKO which is applied by the lower keyboard key-on storing shift register in FIG. 4. The coincidence signal concerning a lower keyboard exclusive channel, which has been selected by the AND circuit, will be referred to as "a coincidence signal CON" when applicable.

The count value of the note counter 80 when the coincidence signal CON is provided is inputted into one of the output registers 72, 73 and 74 under the control of the strobe control circuit 75, and at the same time a block code $AB_1$, $AB_2$ formed in the octave control section 84 is inputted into the one of the output registers 72, 73 and 74. The data inputted into the output register 72, 73 or 74 is not immediately provided as an automatic arpeggio key code $AN_1$-$AB_2$; that is, only the data specified by the strobe control circuit 75 is provided as the automatic arpeggio key code $AN_1$-$AB_2$.

The state control logic 82 has two delay flip-flops 91 and 92 (FIG. 6). The various circuits in the automatic arpeggio circuit 16 are controlled by the signal states ($F_1$ and $F_2$) of the delay flip-flops 91 and 92.

The simultaneous tone-production-number selection signal BO indicates whether one tone should be produced or three tones should be simultaneously produced. That is, when the signal BO is at "1", then the automatic arpeggio circuit 16 operates so that three tones are simultaneously produced; and when it is at "0", then the circuit 16 operates so that only one tone is produced. In other words, the function of the automatic arpeggio circuit 16 is selectively used depending on whether the signal BO is at "1" or "0".

In FIG. 5, the arpeggio simultaneous tone-production-number selection signal BO applied to the simultaneous tone-production-number control circuit 79 is applied through an AND circuit 93 and an OR circuit 96 to a delay flip-flop 95, where it is self-held with the aid of an AND circuit 96. Applied to the other input terminal of the AND circuit 93 is the same load signal $L_1$ as that used to input the arpeggio pattern signal $AP_1$-$AP_4$ into the arpeggio pattern register 76. A signal obtained by inverting the load signal $L_1$ is applied to the other input terminal of the AND circuit 96. This load signal $L_1$ is provided only once when one arpeggio pattern signal $AP_1$-$AP_4$ is given, as described later. Therefore, the signal BO is loaded in the delay flip-flop 95 with the same timing as the arpeggio pattern signal $AP_1$-$AP_4$ is loaded in the register 76, and the signal BO is positively maintained stored therein until the next load signal $L_1$ is provided, i.e., for one arpeggio processing period. The arpeggio simultaneous tone-production-number selection signal BO stored in the delay flip-flop 95 will be designated by reference character BOM.

The simultaneous tone-production-number control circuit 79 further comprises: a ternary counter 97 for three simultaneous tones; and AND circuits 98, 99 and 100. The AND circuits 98 and 99 operate to apply the outputs $Q_1$ and $Q_2$ of the counter 97 to the two least significant bit inputs ($B_1$ and $B_2$) of the adder 78. These circuits 97, 98, 99 and 100 are not operated when the simultaneous tone-production-number selection signal BO, i.e., the signal BOM is at "0" but it is operated when the signal BOM is at "1". That is, the circuits 97 through 100 are operated only in the simultaneous three-tone-production control. When the signal BOM is at "1", the AND circuits 98 and 99 are enabled, and therefore, the count value of the counter 97 is applied to the adder 78, whereby the arpeggio pattern signal $AP_1$-$AP_4$ stored in the arpeggio pattern register 76 is changed by the addition. On the other hand, when the signal BOM is at "0", the AND circuits 98 and 99 are disabled, and therefore the addition input to the adder 78 is zero. Accordingly, the arpeggio pattern signal $AP_1$-$AP_4$ is maintained unchanged and passes through the adder 78.

The three output registers 72, 73 and 74 correspond to three automatic arpeggio exclusive channels, respectively. The automatic arpeggio key code $AN_1$-$AB_2$ which is stored in the output register 72 passes through an AND circuit group 87 with the timing of generation of the automatic arpeggio selection signal $AR_1$, and is then applied through an OR circuit group 101 to the OR circuit group 27 (FIG. 3) which is provided at the input side of the key code memory circuit 19. As was described above, in the assignment control section 21 (FIG. 4) the AND circuit 44 is operated with the aid of the signals $AR_1$ and $YAR_{1\text{-}3}$, and accordingly the key code $AN_1$-$AB_2$ stored in the output register 72 is assigned to one of the automatic arpeggio exclusive channels, i.e., the 12th channel.

The automatic arpeggio key code $AN_1$-$AB_2$ which is stored in the output register 73 passes through an AND circuit group 88 with the timing of the signal $AR_2$, and is then applied through the OR circuit group 101 to the input of the key code memory circuit 19. In the assignment control section 21 the AND circuit 45 (FIG. 4) is operated with the aid of the signals $AR_2$ and $YAR_{2\text{-}3}$, and therefore the key code $AN_1$-$AB_2$ stored in the output register 73 is assigned to one of the automatic arpeggio exclusive channels, i.e., the 15th channel. Similarly, the automatic arpeggio key code $AN_1$-$AB_2$ stored in the output register 74 passes through an AND circuit group 89 with the timing of the signal $AR_3$, and is then applied through the OR circuit group 101 to the input of the key code memory circuit 19. The AND circuit 46 (FIG. 4) is operated with the aid of the signals $AR_3$ and $YAR_{3\text{-}3}$, and the key code $AN_1$-$AB_2$ stored in the output register 74 is assigned to one of the automatic arpeggio exclusive channels, i.e., the 18th channel.

In the case where the simultaneous arpeggio tone-production-number is one (the signal BOM being at "1"), the key codes $AN_1$-$AB_2$ of the automatic arpeggio tones which are produced one at a time at suitable time intervals are successively stored in the output registers 72, 73 and 74.

In the case where the simultaneous arpeggio tone-production-number is three (the signal BOM being at "0"), the key codes of three automatic arpeggio tones which are simultaneously produced are stored in the output register 72, 73 and 74, respectively.

As is apparent from the above description, the output register 72, 73 and 74 are used separately according to the states of the simultaneous tone-production-number selection signal BO (BOM), under the control of the strobe control circuit 75.

The strobe control circuit 75, as shown in FIG. 6, comprises: a ternary counter (strobe counter) 102; AND circuits 103, 104 and 105 for decoding the three count values (0, 1 and 2) of the counter 102; AND circuits 106, 107 and 108 for applying data writing instructions $L_{21}$, $L_{22}$ and $L_{23}$ to the strobe terminals (S) of the output registers 72, 73 and 74 in accordance with the outputs of these AND circuits 103, 104 and 105; and OR circuits 109, 110 and 111 for supplying gate signals $G_{11}$, $G_{12}$ and $G_{13}$ to the AND circuit groups 87, 88 and 89. According to the count value of the strobe counter 102, a note code $AN_1'$-$AB_4'$ from the note counter 80 and an octave code $AB_1$, $AB_2$ from the octave control section 84 are stored in one of the output registers 72, 73 and 74. The counting operation of the strobe counter 102 is controlled by the state control logic 82.

*Description of the arpeggio pattern

An arpeggio pattern to be performed is specified by an arpeggio pattern signal $AP_1$-$AP_4$ which is provided by the pattern generator 23 (FIG. 1). The arpeggio pattern is a 4-bit numerical data, the numerical value of which specifies, among the tones (which are assigned to the lower keyboard exclusive channels) of keys depressed in the lower keyboard, the location order of the tone to be produced as an arpeggio tone as counted from the lowest pitch tone among them. In this case the term "pitch" is not the absolute tone pitch, but is relative tone pitch between twelve notes. As is clear from Table 1, in the note code $N_1$-$N_4$, the minimum value is assigned to note C♯, and the maximum value is assigned to note C. Accordingly, in this embodiment, note C♯ is the lowest note, the tone pitch is increased in the order of notes D, D♯, . . . and B, and note C is the highest, all irrespective of their belonging octaves.

Figure 7:
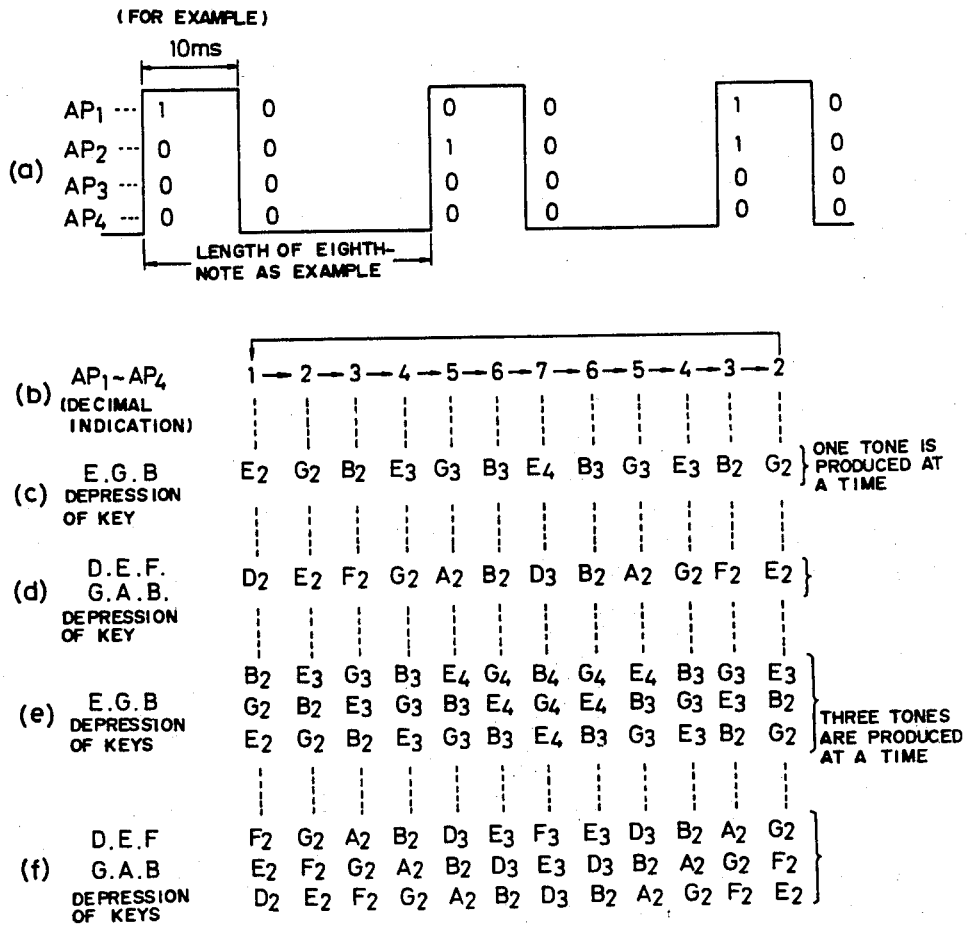
FIG. 7 is a graphical representation showing one example of an arpeggio pattern, and indicating examples of the tones which are produced according to the arpeggio pattern, respectively in a simultaneous one-tone production (monophonic arpeggio) and a simultaneous three-tone production (polyphonic arpeggio)

One example of the generation of arpeggio pattern signal $AP_1$-$AP_4$ in an arpeggio pattern is as shown in FIG. 7. The generation time width of an arpeggio pattern signal $AP_1$-$AP_4$ corresponds to the generation time width of one automatic arpeggio tone, and it is, for instance, of the order of 10 ms, or approximately 10 ms, or longer than 10 ms. The time width can be considered as the period of time during which a key is depressed in a manual arpeggio performance. The generation intervals of the arpeggio pattern signals $AP_1$-$AP_4$ corresponding to the length of a note.

In the case of the part (a) of FIG. 7, the first arpeggio pattern signal $AP_4$, $AP_3$, $AP_2$, $AP_1$ is "0 0 0 1" which is one (1) in decimal notation. This specifies the fact that, among the lower keyboard key depression notes, the first one counted from the lowest tone, i.e., the lowest tone should be produced as an automatic arpeggio tone. The second arpeggio pattern signal $AP_4$-$AP_1$ is "0 0 1 0" (corresponding to two (2) in decimal notation), thus specifying the fact that the second tone from the lowest tone should be produced as an automatic arpeggio tone. As is apparent from the above description, the arpeggio pattern signal $AP_1$-$AP_4$ represents the timing of generation of automatic arpeggio tones and the pitch location order of lower keyboard key depression tones to be selected for automatic arpeggio.

The arpeggio pattern signal $AP_1$-$AP_4$, as a result, includes the octave data of the automatic arpeggio tone. The part (b) of FIG. 7 shows one example of the generation of an arpeggio pattern signal $AP_1$-$AP_4$ by indicating the value thereof with a decimal number. It is assumed that the part (b) of FIG. 7 shows one phrase of arpeggio pattern. Then, in this order, the arpeggio pattern signals $AP_1$-$AP_4$ are repeatedly produced. If the number of keys depressed in the lower keyboard is three (3), then when the third tone's depressed key is selected, selection of all of the depressed keys is accomplished. In this case, the fourth, fifth, sixth and seventh arpeggio constituent tones can be obtained by respectively increasing the octaves of the three arpeggio composing tones (depressed keys'). Accordingly, if the value of an arpeggio pattern signal $AP_1$-$AP_4$ is larger than the total number of arpeggio composing tones (key-depression tones), then the octave range is increased. Thus, the arpeggio pattern signal $AP_1$-$AP_4$ has no octave data which has been provided therefore in advance; that is, the octave data is, as a result (relative to the number of depressed keys), given to the arpeggio pattern signal. The part (c) of FIG. 7 shows arpeggio tones which are produced in accordance with the pattern in part (b) of FIG. 7 when three keys E, G and B are depressed. The part (d) of FIG. 7 shows arpeggio tones which are produced in accordance with the pattern in the part (b) of FIG. 7 in the case where six tones D, E, F, G, A and B have been selected as arpeggio composing tones. Shown in the parts (c) and (d) of FIG. 7 are merely examples to facilitate the understanding, and such arpeggio tones are not always produced in the actual device, because it is possible to carry out an arpeggio performance more naturally by changing the arpeggio pattern in accordance with the number of depressed keys, and even if the number of depressed keys is changed, the same arpeggio pattern is not always specified. No further description of this is made in this specification.

The parts (c) and (d) of FIG. 7 show the case where only one tone is produced at a time. The case where three tones are produced simultaneously will be described.

The arpeggio pattern signal $AP_1$-$AP_4$ itself is not changed by the simultaneous tone-production-number. In this connection, the parts (e) and (f) of FIG. 7 show examples of arpeggio performance in which three tones are simultaneously produced when three or six keys are depressed similarly as in the part (c) and (d), with the pattern shown in the part (b) of FIG. 7. As is apparent from the parts (e) and (f) of FIG. 7, among the three arpeggio tones produced simultaneously, one tone has the order specified by the arpeggio pattern signal $AP_1$-$AP_4$; however, one of the remaining two tones has the order which is higher by one than the order specified by the signal $AP_1$-$AP_4$, and the other has the order which higher by two than the order specified by the signal $AP_1$-$AP_4$. In the example shown in the part (e) of FIG. 7, when the arpeggio pattern signal $AP_1$-$AP_4$ is "1", the first order tone, i.e., the lowest tone E2, the next higher tone G2 and the further next higher tone B2 are simultaneously produced. When the signal $AP_1$-$AP_4$ becomes "2" at the next tone production timing, the second tone G2 from the lowest tone, the next higher tone B2 and the further next higher tone E3 are simultaneously produced.

In the example shown in the part (f) of FIG. 7 also, the tone having the pitch location order specified by the arpeggio pattern signal $AP_1$-$AP_4$, the tone higher by one than the order and the tone higher by two than the order are simultaneously produced. In order to specify the location order which is higher by one or two than the location order specified by the arpeggio pattern signal $AP_1$-$AP_4$, one or two is added to the value of the signal $AP_1$-$AP_4$ in the adder 78 (FIG. 5).

*Description of the waiting time setting circuit 85

When keys depressed in the lower keyboard are assigned to some of the lower keyboard exclusive channels, automatic arpeggio composing tones are prepared and automatic arpeggio tones are produced. If the automatic arpeggio circuit 16 starts to operate before depression of all of the desired keys is accomplished, then a queer pattern arpeggio might be produced. For instance, when the automatic arpeggio circuit 16 is operated before the key of the first tone of the arpeggio tones is depressed, then the second tone is produced as the first tone; that is, the arpeggio performance is started with the incorrect tone. This is due to the fact that the key depression operation effected by a person is fluctuated, and the automatic arpeggio circuit 16 operating in a matter of 1 μs can respond sufficiently to such fluctuation. The waiting time setting circuit 85 is provided for preventing the operation of the automatic arpeggio circuit 16 at the beginning of key depression.

A lower keyboard key depression memory signal LKM from the delay flip-flop 70 in FIG. 4 is applied to the waiting time setting circuig 85 (FIG. 6), and when no key is depressed in the lower keyboard, a three-bit binary counter 113 is maintained reset. When a key is depressed in the lower keyboard, then the signal LKM is raised to "1", as a result of which the reset state of the counter 112 is released, and an AND circuit 113 is enabled, whereby the count pulse T is applied through the AND circuit 113 to the counter 113, where it is counted. When four count pulses T are applied, then the output of the counter 112 becomes "1 0 0", and the the third bit output ($Q_3$) thereof is raised to "1", thus enabling an AND circuit 115. Upon application of seven (7) count pulses T, the output ($Q_3$, $Q_2$, $Q_1$) of the counter 112 becomes "1 1 1", and a NAND circuit 114 provides an output "0". As a result, the AND circuit 113 is disabled, and the counter 112 maintains "1 1 1". A signal Y48 which is applied to the AND circuit 113 together with the pulse T is a pulse which is produced in the 12th channel's time slot in the third processing period H3. The signal Y48 is for count timing synchronization. An AND circuit 116 is to provide a pulse LR2 having a predetermined time width at the start of key depression in the lower keyboard, and the detailed description thereof is omitted.

The output of an AND circuit 115 is maintained at "0" for the period of time (for instance, about 5 to 10 ms) corresponding to four pulses T after a key is depressed in the lower keyboard. The state control logic 82 is so designed that it does not operate when the output signal APT of the AND circuit 115 is at "0". Therefore, in this case, the automatic arpeggio circuit 16 is not operated. During this period, lower keyboard keys which have been depressed substantially simultaneously (somewhat with fluctuation) are suitably assigned to the tone production channels. Thus, after all of the tones necessary for the automatic arpeggio performance have been assigned to the lower keyboard exclusive channels, the automatic arpeggio circuit 16 is enabled.

*Description of the operation under the control of the State control logic 82

Delay flip-flops 91 and 92 in the state control logic 82 have four signal states ($F_1$ and $F_2$), namely, a standby state $ST_0$, a first state $ST_1$, a second state $ST_2$ and a third state $ST_3$. The control of the state control logic 82 in the simultaneous one-tone production (the signal BOM being at "0") is somewhat different from that of the state control logic in the simultaneous three-tone production (the signal BOM being at "1"). Therefore, first the operation of the automatic arpeggio circuit 16 under the control of the state control logic 82 in the simultaneous one-tone production will be described for every state, and then the operation in the simultaneous three-tone production will be described.

Control in the simultaneous one-tone production

As was described before, in the case where only one tone is produced simultaneously (at a time), the simultaneous tone-production-number selection signal BO is at "0", and the signal BOM held in the delay flip-flop 95 (FIG. 5) is also at "0".

(1) Standby state $ST_0$

The standby state $ST_0$ is obtained when the output signal $F_1$, $F_2$ of the delay flip-flops 91 and 92 in FIG. 6 is "0 0".

When no arpeggio pattern signal $AP_1$-$AP_4$ is supplied to the automatic arpeggio circuit 16, or when no key is depressed in the lower keyboard, the standby state $ST_0$ is obtained. The signal $F_1$, $F_2$ becomes "0 0" when all of AND circuits 117 through 126 provided at the input sides of the delay flip-flops 91 and 92 are disabled. A signal APT is applied to all of the AND circuits 117 through 126. When the signal APT is at "0", all of the AND circuits 117 through 126 are disabled. The signal APT is applied to these AND circuit through a delay flip-flop 127 by the AND circuit 115, to which the third bit output ($Q_3$) of the above-described counter 112 and the output APT' of an OR circuit 128 (FIG. 5) are applied. All the bits of the arpeggio pattern signal $AP_1$-$AP_4$ are applied to the OR circuit 128. Accordingly, when no arpeggio pattern signal $AP_1$-$AP_4$ is supplied to the automatic arpeggio circuit 16, i.e., when each of the bits of the signal $AP_1$-$AP_4$ is "0", the AND circuit 115 is not operated, and the signal APT is therefore at "0".

The signal APT is applied through an inverter 129 to a reset line 130. Accordingly, when the signal APT is at "0" the signal $\overline{APT}$ applied to the reset line 130 is at "1". This signal is applied to the reset terminals (R) of various circuits to reset the contents of the latter.

Thus, at the beginning, the signal $F_1$, $F_2$ is set to "0 0" (standby state $ST_0$). Examples of the states of the signals $F_1$ and $F_2$ are indicated in the parts (a) and (b) of FIG. 8, and the corresponding state names ($ST_0$ through $ST_3$) are indicated in the part (c) of FIG. 8.

When the arpeggio pattern signal $AP_1$-$AP_4$ is supplied after the waiting time set by the waiting time setting circuit 85 is over (the AND circuit 115 being enabled), then the output of the OR circuit 128 is raised to "1", and the output signal APT of the AND circuit 115 is also raised to "1". Accordingly, the signal APT (hereinafter referred to as "an arpeggio tone production timing signal" when applicable) is maintained at "1" when one arpeggio pattern signal $AP_1$-$AP_4$ is being supplied (cf. FIG. 7, (*a*)). When the arpeggio tone production timing signal APT is at "1", the output of the inverter 129 is set to "0", or the reset signal $\overline{APT}$ on the reset line 130 is set to "0". Accordingly, when the arpeggio pattern signal $AP_1$-$AP_4$ is supplied, i.e., when the arpeggio tone should be produced, the automatic arpeggio circuit 16 is enabled.

Figure 8:
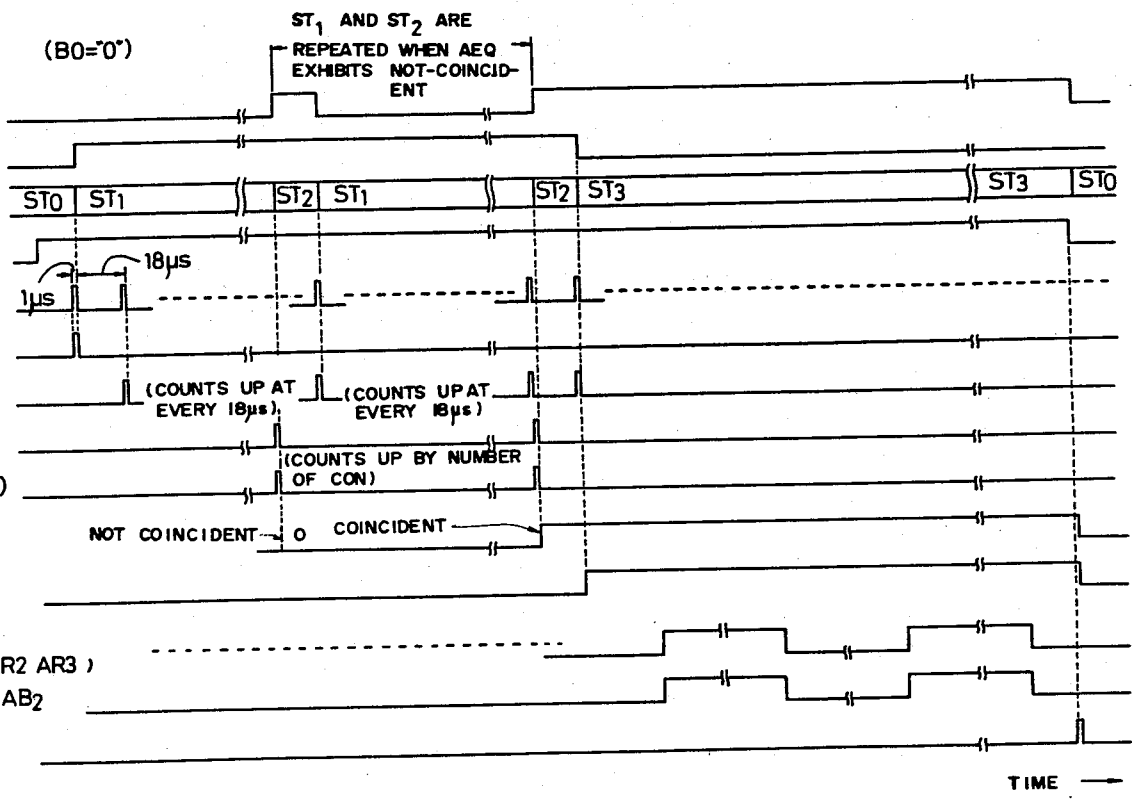
FIG. 8 is a timing chart for a description of the operations of the circuits shown in FIGS. 5 and 6 in the simultaneous one-tone production control.

When, in the standby state $ST_0$, the arpeggio tone production timing signal APT is produced (cf. FIG. 8, (*d*)) and a signal C18 having a time width of 1 μs is provided (cf. FIG. 8, (*e*)), the condition of the AND circuit 122 in the state control logic 82 is satisfied, and a signal "1" is loaded through an OR circuit 131 into the delay flip-flop 92. At the same time, the condition of an AND circuit 132 is satisfied, and a load signal $L_1$ is applied to the arpeggio pattern register 76 (FIG. 5) (cf. FIG. 8, (*f*)). As a result, the arpeggio pattern signal $AP_1$-$AP_4$ is stored in the arpeggio pattern register 76. One microsecond after this, the singal $F_2$ is raised to "1", and the standby state is shifted to the first state $ST_1$.

(2) First state $ST_1$

When the signal $F_1$ is at "0" and the signal $F_2$ is at "1", the first state $ST_1$ is obtained. When the first state $ST_1$ is obtained, the condition of the AND circuit 123 is satisfied, the signal "1" is self-held in the delay flip-flop 92, and the signal $F_2$ is maintained at "1". Thus, the first state $ST_1$ is continuously maintained.

When the signal $F_2$ is set to "1", then the condition of an AND circuit 133 is satisfied whenever the signal C18 is provided, and a count pulse $T_1$ is therefore applied to the note counter 80 (FIG. 5) (cf. FIG. 8, (*g*)).

In the first state $ST_1$, the content of the note counter 80 is increased with the timing of the signal C18 every 18 μs, and the count value of the note counter 80 and the note code $N_1$*-$N_4$* supplied in time division manner by the key code memory circuit 19 (FIGS. 1 and 3) are subjected to comparison in the comparator 81 (FIG. 5). As the data of each channel is provided every 1 μs, the count value of the note counter 80 is compared with the note codes $N_1$*-$N_4$* of all the channels during 18 μs when the count value of the note counter 80 is maintained unchanged. When the note code $N_1$*-$N_4$* of a lower keyboard tone coincides with the count value of the note counter 80, a coincidence signal COIN is applied by the comparator 81 to an AND circuit 90 (FIG. 5), which outputs a coincidence signal CON (FIG. 8, (*h*)) which is supplied to the state control logic 82.

As the content of the note counter 80 is increased beginning with "0 0 0 0", the coincidence signals CON are provided successively for the note codes $N_1$*-$N_4$* beginning with the note code of the lowest tone (the first tone). When one coincidence signal CON is provided, the condition of the AND circuit 117 is satisfied, and a signal "1" is loaded through an OR circuit 134 into the delay flip-flop 91. At the same time, the condition of an AND circuit 135 is satisfied, and therefore a count pulse $T_2$ is supplied to a 4-bit tone number counter (binary counter) (FIG. 5), while a load signal $L_2$ is applied to AND circuits 106, 107 and 108 in the strobe control circuit 75 (FIG. 8, (*i*)). The count value of the tone number counter 83 is increased by one with the pulse $T_2$. A signal "1" is applied to first input terminals of the AND circuits 106, 107 and 108 with the load signal $L_2$. Among these AND circuits, the condition of only the AND circuit which corresponds to the present count value of a strobe counter 102 is satisfied.

The strobe counter 102 is a ternary (modulo 3) counter which is reset by the initial clear signal IC in advance when the power switch is turned on. Thereafter, the content of the counter is repeatedly increased by the output signal ($T_3+T_4$) of an OR circuit 136 in the state control logic 82. The count signal ($T_3+T_4$) will be described later. Now, the description will be further made under the condition that the count value $Q_2$, $Q_1$ of the counter 102 is "0 0".

If the count value $Q_2$, $Q_1$ of the counter 102 is "0 0", then the condition of the AND circuit 103 is satisfied, and a signal "1" is applied to the AND circuit 106. Accordingly, when the load signal $L_2$ is provided, the condition of the AND circuit 106 is satisfied, and a data writing instruction $L_{21}$ is applied to the output register 72 only (FIG. 5). As a result, both the count value $AN_1'$-$AN_4'$ of the counter 80 equal to the note code $N_1$*-$N_4$* which has allowed the production of the coincidence signal CON, and the block code $AB_1$, $AB_2$ which is supplied by the octave control section 84 are stored in the output register 72, but not in the other output register 73 and 74. The count value of the tone number counter 83 represents the order, counted from the lowest one, of the key code $AN_1$-$AB_2$ which is stored in the output register 72. One microsecond (μs) after the provision of the signal $T_2(L_2)$ the output $F_1$ of the delay flip-flop 91 is raised to "1", while the signal $F_2$ is maintained at "1" by means of the AND circuit 123, so that the signal $F_1$, $F_2$ is set to "1 1". Thus, the first state $ST_1$ is shifted to the second state $ST_2$.

As is apparent from the above description, in the first state $ST_1$, the content of the note counter 80 is increased until one coincidence signal CON is provided, and the count value is compared with a note code $N_1$*-$N_4$*.

(3) Second state $ST_2$

When the signal $F_1$, $F_2$ is "1 1", the second state $ST_2$ is obtained. In the second state $ST_2$, the content of the arpeggio pattern signal $AP_1$-$AP_4$ which is stored in the arpeggio pattern register 76 and the count value of the tone number counter 83 are subjected to comparison in the comparator 77 (FIG. 5). When both coincide with each other, a coincidence signal AEQ is outputted by the comparator 77. In the simultaneous one-tone production, one addition input of the adder 78 is zero (0), and therefore the output of the register 76 passes through the adder 78 and is applied to the comparison input of the comparator 77. The key code $AN_1$-$AB_2$ just stored in the output register 72 when the coincidence signal AEQ is produced represents the tone which has the order specified by the arpeggio pattern signal $AP_1$-$AP_4$.

The second state $ST_2$ is maintained until the next timing sinal C18 is provided with the aid of the AND circuits 118 and 124 (FIG. 6). That is, a signal $\overline{C18}$ obtained by applying the signal C18 to an inverter 137 and the signals $F_1$ and $F_2$ are applied to the AND circuits 118 and 124, and the conditions of the AND circuits 118 and 124 are maintained satisfied until the time instant immediately before the signal C18 is provided. The outputs of the AND circuits 118 and 124 are applied to the delay flip-flops 91 and 92, respectively.

First, the case where the count value of the tone number counter 83 is not coincident with the value of the arpeggio pattern signal $AP_1$-$AP_4$ will be described. In this case, in the second state the coincidence signal AEQ is at "0" (cf. FIG. 8, (*j*)). A signal $\overline{AEQ}$ obtained by applying the signal AEQ to an inverter 138 is at "1", and therefore the AND circuit 126 is enabled. Furthermore, the conditions of the AND circuits 126 and 133 are satisfied with the timing of the signal C18. Therefore, a signal "1" is applied through the AND circuit 126 to the delay flip-flop 92 only, with the timing of the signal C18, and one microsecond (μs) after that the signals $F_1$ and $F_2$ are set to "1" and "0", respectively. At the same time, the count pulse $T_1$ is supplied through an AND circuit 133 to the note counter 80. Accordingly, the second state is shifted back to the above-described first state $ST_1$. When one coincidence signal CON is provided in the first state $ST_1$, then the first state is shifted to the second state $ST_2$ again, and the processing is made similarly as described above. The first state $ST_1$ and the second state $ST_2$ are alternately obtained until the production of the coincidence signal AEQ, and the count value of the tone number counter 83 is increased whenever the coincidence signal CON is produced.

When the count value of the tone number counter 83 coincides with the value of the arpeggio pattern signal $AP_1$-$AP_4$, the comparator 77 outputs the coincidence signal AEQ in the second state (cf. FIG. 8, (j)). Accordingly, the condition of the AND circuit 120 in FIG. 6 is satisfied, with the timing of the signal C18 (with the timing of the end of the second state $ST_2$) a signal "1" is supplied through the AND circuit 120 to the delay flip-flop 91 only. Therefore, 1 μs after that, the signal $F_1$ is set to "1" while the signal $F_2$ is set to "0". Thus, the second state is shifted to the third state $ST_3$.

(4) Third state $ST_3$

The third state $ST_3$ is obtained when the signal $F_1$ is at "1" and the signal $F_2$ is at "0". In the third state $ST_3$, the condition of an AND circuit 139 is satisfied, and an arpeggio key code gate signal AGO is provided (FIG. 8, (k)). Furthermore, in the third state $F_3$, as long as the arpeggio tone production timing signal APT is provided, the condition of the AND circuit 121 is satisfied, and the content ($F_1$="1") of the delay flip-flop 91 is held. Accordingly, as long as one arpeggio pattern signal $AP_1$-$AP_4$ is supplied, the third state $ST_3$ is maintained and the arpeggio key code gate signal AGO is continuously produced.

The signal AGO is applied through a delay flip-flop 140 in FIG. 5 to the AND circuit groups 87, 88 and 89 to enable the latter. A gate signal $G_{11}$ is applied to the AND circuit group 87 by the OR circuit 109 in the strobe control circuit 75 (FIG. 6). A gate signal $G_{12}$ is applied to the AND circuit group 88 by the OR circuit 110. A gate signal $G_{13}$ is applied to the AND circuit group 89 by the OR circuit 111.

The outputs of the AND circuits 103, 104 and 105 are applied to the OR circuits 109, 110 and 111, respectively. The simultaneous tone-production-number selection signal BOM is applied to the OR circuits 109, 110 and 111. In the simultaneous one-tone production, the signal BOM is at "0". Consequently, the gate signal $G_{11}$, $G_{12}$ or $G_{13}$ is provided according to the count value of the strobe signal.

When the count value of the strobe counter 102 is zero ($Q_2$ and $Q_1$ being "0"), the condition of the AND circuit 103 is satisfied, so that only the gate signal $G_{11}$ is produced through the OR gate 109, and the other gate signals $G_{12}$ and $G_{13}$ are not produced. Accordingly, only the AND circuit group 87 corresponding to the output register 72 which has stored the note code $AN_1'$-$AN_4'$ from the note counter 80 and the octave code $AB_1$-$AB_2$ is enabled.

The automatic arpeggio selection signal AR1 is applied to the remaining inputs of the AND circuit group 87 which is enabled by the gate signal $G_{11}$ and the arpeggio key code gate signal AGO (FIG. 8, (l)). The arpeggio tone's key code $AN_1$-$AB_2$ which has been stored in the output register 72 is supplied to the key code memory circuit 19 for 54 μs with the timing of the automatic arpeggio selection signal AR1 (FIG. 8, (m)). As the automatic arpeggio selection signal AR1 is repeatedly produced by the key coder 11 at intervals of about 1 to 5 ms as was described before, the automatic arpeggio selection signal AR1 is produced one to several times during the period the arpeggio key code gate signal ARG is produced. In succession with the signal AR1, the signals AR2 and AR3 are produced by the key coder 11; however, these signals are not effective, because the AND circuit groups 88 and 89 are inoperative.

When one arpeggio pattern signal $AP_1$-$AP_4$ disappears, i.e., when the timing of generation of one automatic arpeggio tone is finished, the arpeggio tone production timing signal APT is set to "0", and the third state $ST_3$ is terminated. When the signal APT is set to "0", the output of the inverter 129 (FIG. 6) is raised to "1", so that the reset signal $\overline{APT}$ is applied to the reset line 130. As a result, the note counter 80, the output registers 72, 73 and 74, the arpeggio pattern register 76, the tone number counter 83, and the counter 141 in the octave control section 84 are reset.

When the signal APT is set to "0" in the third state $ST_3$, the condition of an AND circuit 142 (FIG. 6) is satisfied, so that the count pulse $T_4$ is provided (FIG. 8, (n)). The count pulse $T_4$ is applied through the OR circuit 136 to the count input of the strobe counter 102, so that the content of the strobe counter 102 is increased by one, and the count value $Q_2$, $Q_1$ thereof becomes "0 1".

When the signal APT is set to "0", all of the AND circuits 117 through 126 are disabled. Therefore, the output $F_1$, $F_2$ of the delay flip-flops 91 and 92 becomes "0 0", and the standby state $ST_0$ is obtained again.

The key code $AN_1$-$AB_2$ for one of the automatic arpeggio tones is provided in a manner as described above. Since the production of the key code is effected in correspondence to the automatic arpeggio selection signal AR1, the key code is assigned to the channel of the signal $YAR_1$, i.e., the 12th channel, as is clear from the above description (FIG. 2, (e)).

(5) Generation of the automatic arpeggio tone thereafter

When the next arpeggio pattern signal $AP_1$-$AP_4$ is supplied, the automatic arpeggio circuit 16 is operated similarly as in the above described case with the exception that the count value $Q_2$, $Q_1$ of the strobe counter 102 is "0 1 (one in decimal notation)". In response to the count value, the condition of an AND circuit 104 (FIG. 6) is satisfied, and the gate signal $G_{12}$ is applied through the OR circuit 110 to the AND circuit group 88 (FIG. 5). On the other hand, the AND circuit 107 (FIG. 6) is enabled and when the load signal $L_2$ is provided in the first state $ST_1$, the data writing instruction $L_{22}$ is applied to the strobe terminal (S) of the output register 73, so that the arpeggio tone's key code $AN_1$-$AB_2$ is stored in the output register 73. And when, in the third state $ST_3$, the arpeggio key code gate signal AGO is provided, the condition of the AND circuit group 88 is satisfied with the timing of the automatic arpeggio selection signal AR2, so that the key code $AN_1$-$AB_2$ stored in the output register 73 is applied to the key code memory circuit 19. This second arpeggio tone's key code $AN_1$-$AB_2$ is assigned to the channel of the signal YAR2, i.e., the 15th channel (FIG. 2, (f)). The count pulse $T_4$ is produced at the end of the third state $ST_3$, and the count value of the strobe counter 102 is increased by one.

Accordingly, the count value $Q_2$, $Q_1$ of the stobe counter 102 becomes "1 0" corresponding two (2) in decimal notation, and the condition of the AND circuit 105 is satisfied. As a result, the gate signal $G_{13}$ is applied by the OR circuit 111 (FIG. 6) to the AND circuit group 89, and the AND circuit 108 is enabled.

When the next arpeggio pattern signal $AP_1$-$AP_4$ is supplied, then the AND circuit 108 provides the data writing instruction $L_{23}$ in response to the load signal $L_2$, so that the automatic arpeggio tone's key code $AN_1$-$AB_2$ is stored in the output register 74. With the timing of the gate signal AGO and the automatic arpeggio selection signal AR3, the key code stored in the output register 74 is supplied to the key code memory circuit 19 and is assigned to the 18th channel corresponding to the channel signal YAR3 (FIG. 2, (g)). When the count pulse $T_4$ is produced at the end of the third state $ST_3$, the count value of the strobe counter 102 is increased by one; however, since the strobe counter is of the modulo 3, the count value $Q_2$, $Q_1$ is set back to "0 0".

Accordingly, when the next arpeggio pattern signal $AP_1$-$AP_4$ is provided, the output register 72 is used again. Thus, in the case of the simultaneous one-tone production, whenever one of the arpeggio tones is produced the count pulse $T_4$ is produced, so that the content of the strobe counter 102 is changed, the output registers 72, 73 and 74 are successively used, and the arpeggio tones are successively assigned to the three automatic arpeggio exclusive channels. For instance, in the case of the part (c) of FIG. 7, the tone E2 is assigned to the 12th channel, the tone G2 to be produced next is assigned to the 15th channel, and the tone B2 to be produced next is assigned to the 18th channel.

As is apparent from the above description, in the simultaneous one-tone production arpeggio, the three tone production channels are alternately used, and accordingly an arpeggio tone produced previously and an arpeggio tone to be produced next use different channels. Therefore, even if the sustain part of the previous tone and the rise part of the next tone are overlapped, these tones can be continuously produced independently of each other; that is, it is possible to produce arpeggio tones having long sustain parts. This is a significant effect of the invention. If arpeggio tones are successively produced by using one and the same channel, then it is necessary to eliminate the previous tone in order to produce the next tone. In this case, it is impossible to produce arpeggio tone having long sustain parts.

This difficulty has been completely eliminated by the invention.

Control of the simultaneous three-tone production

Figure 9:
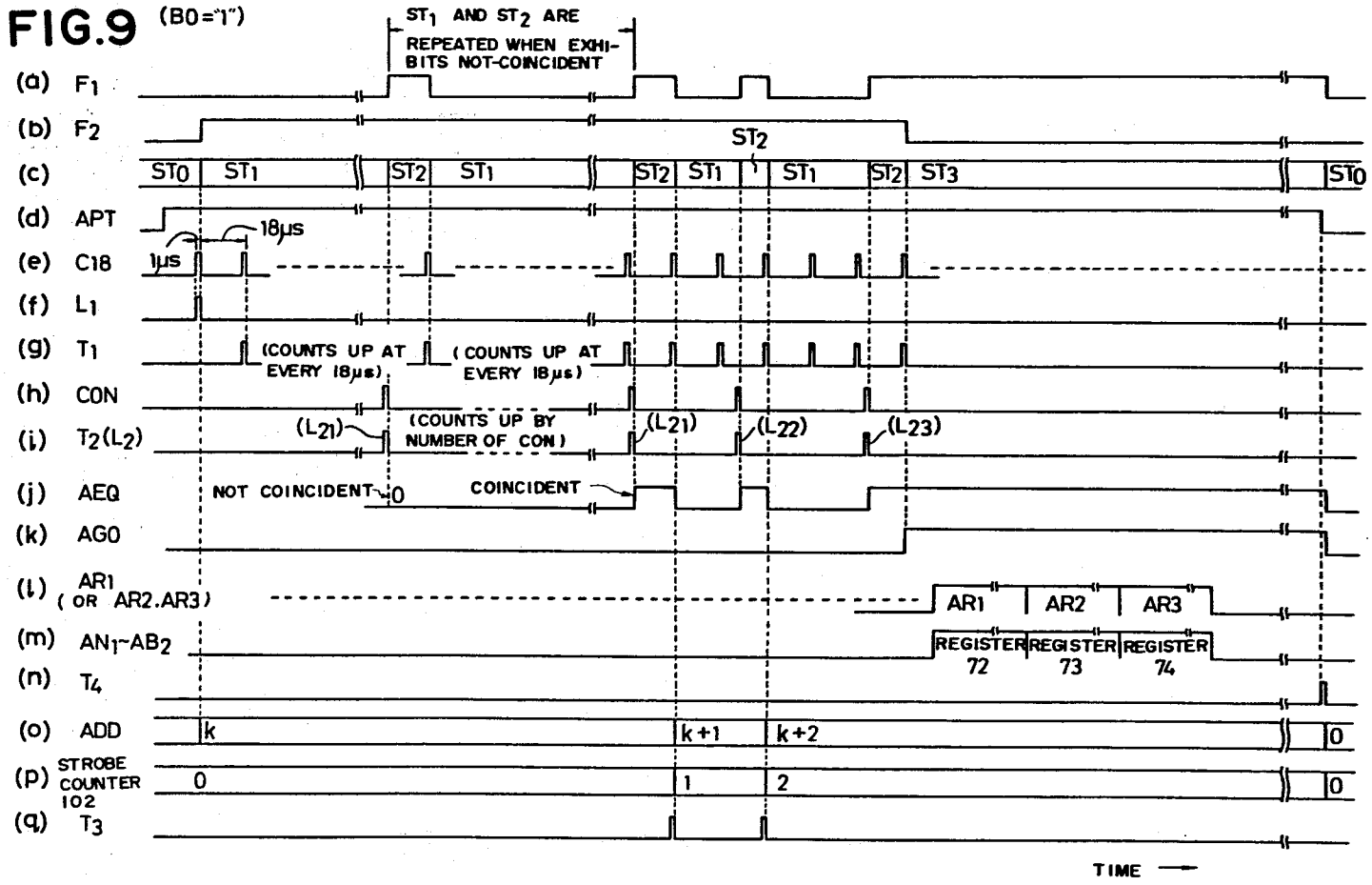
FIG. 9 is a timing chart for a description of the operations of the circuits shown in FIGS. 5 and 6 in the simultaneous plural-tone production control.

FIG. 9 shows the timing chart of various signals in the automatic arpeggio circuit 16 in the simultaneous three-tone production. The parts (a) through (n) of FIG. 9 are for the same signals as those in the parts (a) through (n) of FIG. 8. The controls in the states $ST_0$, $ST_1$, $ST_2$ and $ST_3$ in the simultaneous three-tone production are substantially similar to those described above. Therefore, only the controls different from those in the simultaneous one-tone production will be described.

In the simultaneous three-tone production, the simultaneous tone-production-number selection signal BO is at "1". This signal BO is loaded and stored in the delay flip-flop 95 through the AND circuit 93 (FIG. 5) with the aid of the load signal $L_1$ which is provided at the end of the standby state $ST_0$ (i.e., at the instant one arpeggio pattern signal $AP_1$-$AP_4$ is supplied). As a result, the signal BOM is maintained at "1", and the AND circuits 98 and 99 is maintained enabled. However, as the output $Q_2$, $Q_1$ of the counter 97 is "0 0" at the beginning, one addition input ($B_2$, $B_1$) of the adder 78 is zero.

Accordingly, at the beginning, the arpeggio pattern signal $AP_1$-$AP_4$ stored in the arpeggio pattern register 76 passes through the adder 78, as it is, and is applied to the comparator 77. The value of the output ADD of the adder 78 is as indicated in the part (0) of FIG. 9, in which reference character K designates the value of an arpeggio pattern signal $AP_1$-$AP_4$. The process which is effected from the time instant that one arpeggio pattern signal $AP_1$-$AP_4$ is supplied until the coincidence signal AEQ is firstly provided by the comparator 77 is similar to that in the simultaneous one-tone production described before.

The count value of the strobe counter (FIG. 6) is zero at the beginning (FIG. 9, (p)), the AND circuit 106 is enabled with the aid of the AND circuit 103, and the data writing instruction $L_{21}$ is supplied to the output register 72 whenever the load signal $L_2$ is provided at the end of the first state $ST_1$, so that the output $AN_1'$-$AN_4'$ of the note counter 80 and the output $AB_1$, $AB_2$ of the octave control section 84 are loaded into the output register 72.

When the count value of the tone number counter 83 coincides with the value K of the arpeggio pattern signal $AP_1$-$AP_4$ which is stored in the arpeggio pattern register 76, then the first coincidence signal AEQ is provided in the second state $ST_2$.

Where the first coincidence signal AEQ is provided, the conditions of the AND circuits 125 and 143 (FIG. 6) of the state control logic 82 are satisfied with the timing of the signal C18 which is provided next. The conditions of the AND circuits 125 and 143 are that the second state $ST_2$ is obtained ($F_2$, $F_1$ being "1 1"), that the signal BOM is at "1", that the signals APT, AEQ and C18 are provided, and that the output W of the AND circuit 100 (FIG. 5) is at "0". The condition of the AND circuit 100 is satisfied when the count value $Q_2$, $Q_1$ of the counter 97 is "1 0" corresponding to "two" in decimal notation. As the count value of the counter 97 is zero at the present time, the output W is at "0".

The output "1" of the AND circuit 143 is applied, as the count pulse $T_3$ (FIG. 9, (g)), to the count input of the counter 97, and is further applied through the OR circuit 136 to the count input of the strobe counter 102. As a result, the count value $Q_2$, $Q_1$ of the strobe counter 102 becomes "0 1" (corresponding to one (1) in decimal notation), so that the condition of the AND circuit 104 is satisfied, and the AND circuit 103 is disabled. At the same time, the the count value $Q_2$, $Q_1$ of the counter 97 becomes "0 1".

Accordingly, the writing instruction $L_{21}$ to the first output register 72 is produced no longer, and therefore the key code $AN_1$-$AB_2$ permitting the provision of the first coincidence signal AEQ is maintained stored in the output register 72. The key code $AN_1$-$AB_2$ stored in the output register 72 corresponds to a tone having the order which has been specified by the arpeggio pattern signal $AP_1$-$AP_4$.

On the other hand, as the output of the AND circuit 125 is at "1", the signal "1" is stored in the delay flip-flop 92 only, but not in the delay flip-flop 91. Therefore, the signals $F_1$ and $F_2$ become "0" and "1", respectively. Therefore, even if the coincidence signal AEQ is produced, the third state $ST_3$ is not obtained, and instead the first state $ST_1$ is obtained immediately after the provision of the count pulse $T_3$ (FIG. 9, (c)).

As the output of the three-tone counter 97 becomes "0 1" as described above, the data "0 1" is inputted into the two least significant bits ($B_2$ and $B_1$) of the adder 78 through the AND circuits 98 and 99. As a result, the adder 78 outputs a value (k+1) which is obtained by adding one (1) to the value (k) of the arpeggio pattern signal $AP_1$-$AP_4$ (FIG. 9, (o)). Accordingly, in the comparator 77, the value (k+1) obtained from the value (k) of the arpeggio pattern signal $AP_1$-$AP_4$ is compared with the count value of the tone number counter. At the present time, the count value of the tone number counter 83 is k, and therefore the coincidence signal AEQ which has been firstly produced by the comparator 77 is eliminated.

In the first state $ST_1$, with the timing of the signal C18, the count pulse $T_1$ is supplied to the note counter 80, so that the content of the note counter 80 is further increased. When, during this operation, the coincidence signal CON is firstly provided, the count value of the tone number counter 83 is increased by one by the count pulse $T_2$, and the data writing instruction $L_{22}$ is outputted by the AND circuit 107 corresponding to the AND circuit 104 in response to the load signal $L_2$.

As a result, the count value of the tone number counter 83 has the value (k+1), and the output register 73 stores the key code $AN_1$-$AB_2$ of a tone which has the order (k+1) which is higher by one that the order (k) specified by the arpeggio pattern signal $AP_1$-$AP_4$. Thus, the value (k+1) obtained by changing the value (k) of the pattern signal $AP_1$-$AP_4$ coincides with the count value of the tone number counter 83, and the coincidence signal AEQ is provided by the comparator 77.

When, as was described before, the coincidence signal CON is produced in the state $ST_1$, the state $ST_1$ is shifted to the second state $ST_2$. In this case, the output $Q_2$, $Q_1$ of the three-tone counter 97 (FIG. 5) is "0 1", and therefore the condition of the AND circuit 100 is not satisfied, and the signal W is at "0". Accordingly, when the signal C18 is firstly produced after the state $ST_1$ has been shifted to the state $ST_2$, the conditions of the AND circuits 125 and 143 (FIG. 6) are satisfied, so that the AND circuit 143 provides the count pulse $T_3$. At the same time, the second state $ST_2$ is shifted back to the first state $ST_1$ by the output "1" of the AND circuit 125.

Each of the contents of the three-tone counter 97 and the strobe counter is further increased by one with the aid of the count pulse $T_3$, and the count value $Q_2$, $Q_1$ becomes "1 0" corresponding to "2" in decimal notation. By the count value of the strobe counter 102, the condition of the AND circuit 105 is satisfied, and the AND circuit 108 is enabled. On the other hand, the output "1, 0" of the three-tone counter 97 is inputted through the AND circuits 98 and 99 into the two less significant bits ($B_2$, $B_1$) of the adder 78. As a result, the adder 78 outputs a value (k+2) which is obtained by adding (2) to the value (k) of the arpeggio pattern signal $AP_1$-$AP_4$.

Thus, the value (k+2) obtained by changing the value (k) of the arpeggio pattern signal $AP_1$-$AP_4$ is compared with the count value of the comparator 88 in the comparator 77. As the present count value of the counter 88 is (k+1), the coincidence signal AEQ which has been secondly produced is eliminated.

As the output $Q_2$, $Q_1$ of the three-tone counter 97 has become "1 0", the condition of the AND circuit 100 is satisfied, and the signal W is raised to "1".

Similarly as in the above-described case, in the first state $ST_1$, the count pulse $T_1$ is supplied to the note counter 80 with the timing of the signal C18, so that the content of the note counter 80 is further increased. When, during the operation, the coincidence signal CON is firstly produced, then the content of the tone number counter 83 is increased by one by the count pulse $T_2$, and the AND circuit 108 outputs the data writing instruction $L_{23}$ in response to the load signal $L_2$.

As a result, the count value of the tone number counter 83 becomes (k+1), and the output register 74 stores the key code $AN_1$-$AB_2$ of a tone having the order (k+2) which is higher by two than the order (k) specified by the arpeggio pattern signal $AP_1$-$AP_4$. Accordingly, the value (k+1) obtained by changing the value of the pattern signal $AP_1$-$AP_4$ coincides with the count value of the tone number counter 83, and the comparator 77 outputs the coincidence signal AEQ.

As was described before, when the coincidence signal CON is provided in the state $ST_1$, the state $ST_1$ is shifted to the second state $ST_2$. Now, the signal W is at "1". Therefore, when the signal C18 is firstly produced after the first state $ST_1$ has been shifted to the second state $ST_2$, then the condition of the AND circuit 119 (FIG. 6) of the state control logic 82 is satisfied, but the conditions of the AND circuits 125 and 143 are not satisfied. As only the output of the AND circuit 119 is set to "1", the signal "1" is loaded in the delay flip-flop 91, but not in the delay flip-flop 92. Accordingly, one microsecond after that, the signals $F_1$ and $F_2$ are set to "1" and "0", respectively, and the second state is shifted to the third state $ST_3$.

In the third state $ST_3$, as was described before, the AND circuit 121 is enabled, and the state $ST_3$ is maintained as long as the arpeggio tone production timing signal APT is produced. The AND circuit 139 outputs the arpeggio key code gate signal AGO, which is supplied to the AND circuit groups 87, 88 and 89 corresponding respectively to the output registers 72, 73 and 74. On the other hand, in the case of the simultaneous three-tone-production control, the signal BOM is applied to the OR circuits 109, 110 and 111 (FIG. 6) in the strobe control circuit 75 at all times, and the three gate signals $G_{11}$, $G_{12}$ and $G_{13}$ are supplied to the AND circuit groups 87, 88 and 89, respectively.

Accordingly, in the third state $ST_3$, all of the AND circuit groups 87, 88 and 89 (FIG. 5) are enabled. As the three automatic arpeggio selection signals AR1, AR2 and AR3 each having a time width of 54 μs are successively provided by the key coder 11 (FIG. 9, (l)), the corresponding AND circuit group 87, 88 and 89 are successively rendered conductive, and therefore the arpeggio tones' key codes $AN_1$-$AB_2$ stored in the output registers 72, 73 and 74 are successively supplied to the tone production assignment circuit section 15 (FIG. 1).

As was described before, the key code $AN_1$-$AB_2$ of the arpeggio tone having the tone pitch order specified by the arpeggio pattern signal $AP_1$-$AP_4$ has been stored in the output register 72. This key code is supplied to the tone production assignment circuit section 15 in response to the signal AR1, so as to be assigned to the 12th channel. The key code $AN_1$-$AB_2$ of the arpeggio tone having the order which is higher by one than the tone pitch order specified by the signal $AP_1$-$AP_4$ has been stored in the output register 73, and the key code is assigned to the 15th channel in response to the signal AR2. Furthermore, the key code $AN_1$-$AB_2$ of the arpeggio tone having the order which is higher by two than the tone pitch order specified by the signal $AP_1$-$AP_4$ has been stored in the output register 74, and the key code is assigned to the 18th channel in response to the signal AR3. Thus, in accordance with the three tones' key codes $AN_1$-$AB_2$ assigned to the three arpeggio exclusive channels, the musical tones are produced in the respective channels, and the three tones are simultaneously produced according to the one arpeggio pattern signal $AP_1$-$AP_3$ (i.e., with one arpeggio tone production timing).

For instance, in the case of the part (e) of FIG. 7, when the value of an arpeggio pattern signal $AP_1$-$AP_4$ is one (1), then the key code of tone E2 is stored in the output register 72, the key code of G2 is stored in the output register 73, and the key code of B2 is stored in the output register 74, because among the arpeggio composing tones E, G and B, E is the lowest tone (order 1), G has the order which is higher by one than the order 1, and B has the order which is higher by two than the order 1.

When in the third state $ST_3$, the one arpeggio pattern signal $AP_1$-$AP_4$ which has been continuously supplied is eliminated, then the arpeggio tone production timing signal APT is set to "0", and the count pulse $T_4$ is provided by the AND circuit 142. As a result, the content of the strobe counter 102 is increased by one from "1 0" corresponding to "two" in decimal notation; however, since the counter 102 is of the modulo 3, the count content thereof is set back to "0 0". Furthermore, when the signal APT is set to "0", the three-tone counter 97 is reset, so that the count value thereof is set to "0 0". Thus, the third state $ST_3$ is shifted back to the standby state $ST_0$, which is maintained until the next arpeggio pattern signal $AP_1$-$AP_4$ is supplied.

*Description of the octave control section 84

The octave range of an automatic arpeggio tone is changed whenever the note counter 80 (FIG. 5) outputs a carry signal CARY. The content of the 4-bit note counter 80 is increased beginning with "0". When the count pulse $T_1$ is supplied to the note counter 80 whose content has reached "1 1 1 1", the content "1 1 1 1" is set back to "0 0 0 0". One circulation of the counting operation of the note counter 80 as described above means that one series of note codes $N_1$*-$N_4$* of lower keyboard key depression tones supplied by the key code memory circuit 19 have been detected (or a series of coincidence signals CON have been provided for these note codes $N_1$*-$N_4$*). In the case when no coincidence signal AEQ is provided by the comparator 77 although all of the key depression tones' note codes $N_1$*-$N_4$* have been detected, i.e., the number of detection of coincidence signals CON does not reach the tone number specified by the arpeggio pattern signal $AP_1$-$AP_4$ (or the tone number changed by the adder 78), the octave range is changed.

(1) In the up mode

In the case where the up mode has been selected, an up/turn selection signal UT is at "1", and it is applied to an OR circuit 144 and an AND circuit 145. As a result, a flip-flop 146 is reset through the OR circuit 114. The flip-flop 146 is to control the count mode of a reversible counter 141. The output $\overline{Q}$ of the flip-flop 146 is set to "1", when the flip-flop 146 is reset. When the output $\overline{Q}$ is at "1", the counter 141 is set in an up-count mode. In the up-count mode, a signal "1" is applied to AND circuits 145, 147 and 148. When, under this condition, the carry signal CARY is provided by the note counter 80, the signal "1" is outputted by the AND circuit 147, so that a count pulse is applied through an OR circuit 149 to the counter 141. Thus, the content of the counter 141 is increased whenever the carry signal CARY is provided.

The output of the 2-bit binary counter 141 is applied to an adder 150, so that one (1) is added in the adder 150. The output of the adder 150 is a block code $AB_1$, $AB_2$ representative of the octave range of an automatic arpeggio tone, and it is applied to the output registers 72, 73 and 74. The reason why one is added in the adder is to establish the relation between the block code $AB_1$, $AB_2$ and the octave range as indicated in Table 2 described before. The relation between the output of the counter 141 and the block code $AB_1$, $AB_2$ outputted by the adder 150 is as indicated in Table 3 below:

TABLE 3

| Counter | 141 | $AB_2$ | $AB_1$ | Octave range |
|---|---|---|---|---|
| 0 | 0 | 0 | 1 | C2#-C3 |
| 0 | 1 | 1 | 0 | C3#-C4 |
| 1 | 0 | 1 | 1 | C4#-C5 |
| 1 | 1 | 0 | 0 | C5#-C6 |

When the output of the counter 141 reaches the value "1 1" corresponding to the highest octave range, the output of an AND circuit 151 is raised to "1" to disable the AND circuit 147. Where the carry signal CARY is produced thereafter, in the case of the up mode the AND circuit 145 outputs a signal "1" which is applied through an OR circuit 152 to the counter 141 to reset the latter 141. Accordingly, when the content of the counter 141 reaches the value corresponding to the highest octave range, then the content of the counter 141 is increased beginning with the value "0 0" corresponding to the lowest octave range. Thus, in the up mode, the octave range of an autmatic arpeggio tone is repeatedly increased from the lowest octave to the highest octave.

(2) In the turn mode

In the case where the turn mode has been selected, the up/turn selection signal UT is at "0", and the output of the inverter 153 is raised to "1". The output "1" of the inverter 153 is applied to the AND circuit 148. The flip-flop 146 and the counter 141 has been initially reset by the reset signal $\overline{APT}$ on the reset line 130. Therefore, the output $\overline{Q}$ of the flip-flop 146 is at "1", which indicates the up count. In the case of the up count, similarly as in the above-described up mode, a count pulse is applied through the AND circuit 147 and the OR circuit 149 to the counter 141 in response to the carry signal CARY from the note couner 80, and the carry signal CARY is subjected to up-count in the counter 141. Accordingly, the octave range specified by the block code $AB_1$, $AB_2$ is sucessively increased. When the count value of the counter 141 reaches the value corresponding to the highest octave, then the AND circuit 151 outputs a signal "1", which is applied to the AND circuit 148. In the turn mode, the AND circuit 145 is maintained disabled. The flip-flop 146 applies to the other input terminal of the AND circuit 148 a signal $\overline{Q}$ ("1") representative of the up-count mode. When the carry signal CARRY is provided under this condition, the condition of the AND circut 148 is satisfied, so that the flip-flop 146 is set through the OR circuit 157 (the count value being increase by one). Therefore, the output $\overline{Q}$ of the flip-flop 146 is set in the down-count mode. In this case, the count value of the counter 141 is "1 1". The output $\overline{Q}$ (signal "0") of the flip-flop 146 is inverted by an inverter 156 and is then applied to AND circuits 154 and 155. In addition, the AND circuit 147 is disabled. In the case of the down-count, the carry signal CARY is selected by the AND circuit 154, and is applied to the counter 141. The content of the counter 141 is decreased by one whenever the carry signal CARY is applied. When three carry signals CARY are applied, then the count value of the counter 141 becomes "0 0", and a signal "1" is outputted by a NOR circuit 158. By the output signal "1" of the NOR circuit 158, the AND circuit 154 is disabled, and the AND circuit 155 is enabled. Therefore, when the carry signal CARY is provided thereafter, the condition of the AND circuit 155 is satisfied, so that the signal "1" is applied through the OR circuit 157 to the flip-flop 146, where one of counted. The flip-flop 146 is a 1-bit counter, and as the previous data was "1" ($\overline{Q}$ being "0"), now it is inverted into "0" (Q being "0"). Thus, the up-count mode is obtained again.

Thus, the count value of the octave counter 141 is repeatedly increased and decreased, so that the increase (i.e., switching the octave range from the lowest octave towards the highest octave) and the decrease (i.e. switching the octave range from the highest octave towards the lowest octave) of the octave range specified by the block code $AB_1$, $AB_2$ are repeatedly carried out.

The above-described octave process is carried out for every arpeggio tone process (which is the process effected until one coincidence signal AEQ is produced). Only the block codes $AB_1$, $AB_2$ stored in the output registers 72, arpeggio tones' key codes $AN_1$–$AB_2$, when the arpeggio key code gate signal AGO is provided.

*Modifications

In the above-described embodiment of the invention, the number of arpeggio tones which are produced simultaneously is selected to be one or three. However, it should be note that the invention is not limited thereto or thereby. That is, simultaneous two-tone production can be achieved, or the arrangement may be so designed that the one-tone production, the two-tone production and the three-tone production can be switched, by slightly modifying the simultaneous tone-production-number control circuit 79 (FIG. 5). That is, the simultaneous two-tone production can be achieved by modifying the control circuit 79 in such a manner that the signal W is produced when the count value $Q_2$, $Q_1$ of the counter 97 is "0 1".

Furthermore, it is possible to increase the simultaneous tone production number to more than three. This can be achieved by increasing the number of automatic arpeggio exclusive channels, increasing the modulo numbers of the counter 97 and the strobe counter 102, increasing the number of output registers (72, 73 and 74), and setting the conditions of generation of the signal W according to the desired simultaneous tone production number.

In the above-described embodiment, selecting and switching the arpeggio tones' simultaneous tone production number are effected by manually operating the switch 12A. However, this can be achieved by applying the selection signal BO, in data form, from a read-only memory (ROM) incorporated in the electronical musical instrument or an external device. In this case, the simultaneous tone-production-number selection signal BO may be data having a plurality of bits. For instance, a method may be employed in which the simultaneous tone-production-number selection signal BO is stored in a memory unit in the pattern generator 23 (FIG. 1) in advance, and it is read out together with the arpeggio pattern signal $AP_1$–$AP_4$ in response to the selecting operation of the pattern selector 24. In this case, the arrangement can be so made that the value of the simultaneous tone-production-number selection signal BO is not always fixed, and instead suitably switched during the automatic arpeggio performance. For instance, it is possible that with the timing of generation of the arpeggio pattern signal $AP_1$–$AP_4$ concerning the tone of the first beat the signal BO is set to "1" to effect the simultaneous three-tone (plural-tone) production, and with the timing of generation of the arpeggio pattern signal $AP_1$–$AP_4$ concerning the tone of the second beat or so forth the signal BO is set to "0" to effect the simultaneous one-tone production. In order to realize thais control, it is unnecessary to modify the automatic arpeggio circuit 16 shown in FIGS. 5 and 6 at all. That is, all that is necessary is to set the generation of the simultaneous tone-production-number signal BO in a desired pattern, and to generate it in the pattern generation 23. In addtion, a performance pattern can be obtained in which at a desired tone production timing both a tone specified by the arpeggio pattern signal $AP_1$–$AP_4$ and the tone higher by one octave than the tone arm simultaneously produced, and at the other arpeggio tone production timing only one tone is produced. This can be achieved by slightly modifying the simultaneous tone-production-number control circuit 79 in the automatic arpeggio circuit 16 shown in FIG. 5, and the concrete circuit can be readily obtained from the above description.

In the above-described embodiment, the arpeggio composing tones are specified by the lower keyboard; however, the other keyboards may be employed to specify the arpeggio composing tones, or the arpeggio composing tones may be tones which are formed automatically by automatic bass chord performance processing.

As is apparent from the above description, with the electronic musical instrument according to the invention, a plurality of arpeggio tones can be produced simultaneously in an automatic arpeggio performance; that is, an intricate automatic arpeggio performance can be carried out and the performance function is much improved. Furthermore, a plurality of arpeggio tone production channels are provided according to the invention. Accordingly, in the case where only one tone is produced at a time, the arpeggio tones which are to be successively produced can be assigned successively to the different channels, whereby of the successively produced arpeggio tones, the present one can be produced without eliminating the sustain part of the previous one, which makes it possible to produce arpeggio tones having long sustain parts.

In the case where a plurality of arpeggio tones are produced simultaneously, the value of the arpeggio pattern signal $AP_1$–$AP_4$ for one arpeggio tone is successively changed to form the signals which specify the pitch location order according to which the tones are produced. Accordingly, the arpeggio pattern signal which is stored in the memory unit of the pattern generator 23 in advance is for only one tone. Thus, it is possible to improve the performance function without increasing the scale of the circuitry. In addition, in the automatic arpeggio circuit, the same circuits can be used commonly for the simultaneous one-tone production and the simultaneous plural-tone production, which makes it possible to further improve the performance function without increasing the scale of the circuitry.

What is claimed is:

1. In a polyphonic keyboard electronic musical instrument of the type in which musical tones are produced in a tone generator having a number of tone production channels considerably fewer than the number of keyboard keys, each channel producing a tone established by a key code supplied thereto, the improvement for arpeggio tone production wherein:

more than one of said tone production channels are dedicated only to the production of arpeggio tones, together with: automatic arpeggio circuit means for selectively supplying arpeggio tone designating key codes sequentially or simultaneously to respective different ones of said dedicated tone production channels at consecutive arpeggio tone production times.

2. An electronic musical instrument according to claim 1 wherein the order of arpeggio tone production is in accordance with a pattern established by an arpeggio pattern generator, and wherein:

said automatic arpeggio circuit means includes circuitry, operative at each consecutive arpeggio tone production time, to supply the key code for the arpeggio tone then to be produced in accordance with said pattern to a dedicated tone production channel different from the channel to which the previous arpeggio tone key code was supplied at the next earlier tone production time without terminating the supply of said previous key code to the other channel, whereby consecutive arpeggio tones are produced in different channels and the production of each arpeggio tone can be sutained beyond the initiation of production of the next arpeggio tone.

3. An electronic musical instrument according to claim 1 wherein the order of arpeggio tone production is designated in accordance with a pattern established by an arpeggio pattern generator, and wherein:

said automatic arpeggio circuit means includes circuitry, operative at each arpeggio tone production time, to supply concurrently to respective different ones of said dedicated tone production channels the key code for the arpeggio tone designated for current production by said pattern, and the key code for at least one additional arpeggio tone designated by said pattern for subsequent tone production, whereby said currently designated and at least one additional designated arpeggio tones are simultaneously produced.

4. An electronic musical instrument comprising:

keyboard keys;

first means for specifying note information corresponding to depressed ones of said keys;

second means for generating, based on said specified note information, arpeggio tone information including tone pitch data and sounding time data for automatic arpeggio performance;

a plurality of tone production channels each producing a musical tone designated by tone information assigned thereto, the number of such tone production channels being considerably fewer than the number of keys of the instrument, a certain subset of more than one tone production channels being exclusively dedicated for performance of arpeggio tones; and third means for assigning said arpeggio tone information to available ones of said dedicated subset of tone production channels, thereby rendering production of arpeggio tones as designated by said arpeggio tone information.

5. An electronic musical instrument according to claim 4 wherein:

said second means is means for selecting, at each one arpeggio tone production time, one of said note information specified upon depression of said keys and generating arpeggio tone information with respect to the selected note information, and said third means is means for sequentially assigning arpeggio tone information generated by said second means to respective different available ones of said dedicated subset of tone production channels at consecutive arpeggio tone production times so that sequential arpeggio tones are generated separately in the respective channels.

6. An electronic musical instrument according to claim 4 wherein:

said second means is means for selecting, at each one arpeggio tone production timing, a plurality of note information not exceeding the total number of said dedicated subset of production channels from said note information specified upon depression of said keys and generating arpeggio tone information with respect to the selected note information, and said third means is means for assigning respective arpeggio tone information generated by said second means to respective available ones of said dedicated subset of tone production channels at each arpeggio tone production timing, thereby simultaneously generating a plurality of tones at every timing in an arpeggio performance.

7. An electronic musical instrument capable of automatically carrying out an arpeggio performance having keyboard keys and a plurality of tone production channels for selectively producing tones in accordance with arpeggio forming tones specified upon depression of said keys, comprising:

first means for designating a predetermined sequential order of production of the respective arpeggio forming tones;

second means for selecting one of the specified arpeggio forming tones according to the designation of said first means at each respective tone production time and generating tone information with respect to the selected tones;

third means, cooperating with said second means, for further selecting arpeggio forming tones other than that one designated according to said first means at the same tone production time, and for causing said second means to further generate tone information with respect to said further selected arpeggio forming tones; and fourth means connected to said second means for assigning the respective tone information generated from said second means to respective ones of a subset of tone production channels, the channels of said subset being exclusively dedicated to the production of arpeggio tones.

8. An electronic musical instrument according to claim 7 wherein said third means is means which is selectively rendered operative or not operative in accordance with a simultaneous tone-production-number selection signal thereby to selectively inhibit the operation of said third means when said selection signal designates only one tone production and to otherwise selectively allow said third means to simultaneously generate a plurality of tones in cooperation with said second means when said selection signal designates simultaneous production of a plurality of tones at each arpeggio tone production time.

9. An electronic musical instrument according to claim 8 wherein said third means includes a simultaneous tone-production-number selection switch and generates, as said simultaneous tone-production-number selection signal, a signal according to the setting of said selection switch.

10. An electronic musical instrument according to claim 8 wherein said third means includes a memory for storing the production pattern of said selection signal in advance and generates, as said simultaneous tone-production-number selection signal, a signal corresponding to the production pattern read out from said memory with lapse of time.

11. An electronic musical instrument according to claim 7 wherein said first means is means for generating numerical data for establishing the tone to be selected at predetermined respective tone production times, said second means includes a tone information selection generator for selecting the tone established by the numerical data from the arpeggio forming tones and generating tone information with respect to the selected tone, and a controller for controlling said tone information selection generator to selectively use the numerical data from said first means and data from said third means at one tone production time in time division manner, said third means changing the numerical data generated from said first means to one or plural data, supplying the changed respective numerical data to said tone information selection generator in said second means and allowing said tone information selection generator to generate tone information according to the changed numerical data under the control of said controller in said second means, and said fourth means includes a plurality of memory circuits respectively corresponding to specified tone production channels, and a strobe control circuit for storing the tone information generated from said tone information selection generator respectively in said memory circuits.

12. An electronic musical instrument according to claim 11 wherein said third means includes a simultaneous tone-production-number control circuit for generating one or plural predetermined numerical signals displaced at timing under the control of said controller, and an adder connected to said simultaneous tone-production-number control circuit for adding the numerical data generated from said first means to said numerical signals and supplying the added result of said tone information selection generator, and said strobe control circuit is a circuit for storing the tone information generated from said tone information selection generator in predetermined said memory circuits in accordance with the selective usage of the respective numerical data in said controller.

* * * * *